US006872925B2

(12) United States Patent
Asakura et al.

(10) Patent No.: US 6,872,925 B2
(45) Date of Patent: Mar. 29, 2005

(54) IMAGE HEATING DEVICE USING INDUCTION HEATING AND IMAGE FORMING APPARATUS

(75) Inventors: Kenji Asakura, Souraku-gun (JP); Noboru Katakabe, Uji (JP); Keisuke Fujimoto, Hirakata (JP); Masaru Imai, Hirakata (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/626,920

(22) Filed: Jul. 25, 2003

(65) Prior Publication Data

US 2004/0136761 A1 Jul. 15, 2004

(30) Foreign Application Priority Data

Aug. 5, 2002 (JP) ..... 2002-227837

(51) Int. Cl.[7] ..... H05B 6/14; G03G 15/20

(52) U.S. Cl. ..... 219/619; 219/670; 219/663; 399/328

(58) Field of Search ..... 219/619, 670, 219/661, 663, 668, 672; 399/328–338

(56) References Cited

U.S. PATENT DOCUMENTS 6,037,576 A * 3/2000 Okabayashi et al. ..... 219/619
6,373,036 B2 * 4/2002 Suzuki ..... 219/619
6,483,088 B2 * 11/2002 Uehara et al. ..... 219/619

FOREIGN PATENT DOCUMENTS

| | | | |
|---|---|---|---|
| JP | 10-74009 | * | 3/1998 |
| JP | 2001-60490 | | 3/2001 |
| WO | WO 02/29498 | * | 4/2002 |

* cited by examiner

*Primary Examiner*—Philip H. Leung
(74) *Attorney, Agent, or Firm*—Merchant & Gould P.C.

(57) ABSTRACT

An image heating device includes a heat generating member that heats a body to be heated that is allowed to travel while carrying an image, an excitation unit that is provided close to the heat generating member and generates magnetic flux so as to cause the heat generating member to generate heat by electromagnetic induction, and a heat generation suppressing unit that suppresses an amount of heat generated in the heat generating member by regulating magnetic flux generated by the excitation unit. The heat generation suppressing unit suppresses heat generation of the heat generating member in a region corresponding to a region including at least a center portion of the body to be heated in a width direction. Thus, an amount of heat generated in the width direction can be regulated using a simple configuration at a reduced cost. Further, when the heat generation suppressing unit is operated, diffusion of magnetic flux into a wide area can be prevented.

18 Claims, 17 Drawing Sheets

IMAGE HEATING DEVICE USING INDUCTION HEATING AND IMAGE FORMING APPARATUS

BACKGROUND OF THE INVENTION

1. Field of the Invention

The present invention relates to an image forming apparatus such as an electrophotographic apparatus and an electrostatic recording apparatus. Further, this invention relates to an image heating device for fixing an unfixed image that is used in such an image forming apparatus and employs an electromagnetic induction heating method.

2. Related Background Art

JP2001-60490 A discloses an image heating device employing the electromagnetic induction heating method.

FIG. 22 is a cross sectional view of the image heating device disclosed in JP2001-60490 A.

In FIG. 22, reference numeral 901 denotes a heating tube that generates heat by induction heating. The heating tube 901 is fitted on an outer periphery of a guide 907 in the shape of a cylindrical tube and supported rotatably. Further, reference numeral 902 denotes a pressure roller that makes contact under pressure with the heating tube 901. A recording paper sheet 908 is passed through a nip part (pressure-contact part) between the heating tube 901 and the pressure roller 902, so that an unfixed toner image formed on the recording paper sheet 908 is fixed thermally. Further, reference numeral 904 denotes an excitation coil that is disposed in an inner portion of the guide 907 and generates a high-frequency magnetic field. Reference numeral 905 denotes a core that is disposed at a winding center of the excitation coil 904, and reference numeral 906 denotes a cancel coil that is wound on an outer periphery of the core 905 and regulates an amount of heat generated.

The recording paper sheet 908 carrying the unfixed toner image is conveyed to the nip part in a direction indicated by an arrow 910 in FIG. 22. Using the heat of the heating tube 901 and the pressure exerted between the heating tube 901 and the pressing roller 902, a fixed toner image is formed on the recording paper sheet 908.

FIG. 23 is a plan view of the cancel coil 906 provided in the image heating device shown in FIG. 22 as seen from a direction indicated by an arrow S. A lateral direction in a plane of FIG. 23 corresponds to a rotation axis direction of the heating tube 901 shown in FIG. 22, which corresponds to a width direction of a recording paper sheet that is passed.

As shown in FIG. 23, loop portions 906*a* and 906*b* of the cancel coil 906 are positioned so as to correspond to both ends of a recording paper sheet that is passed. A switching element 909 is connected across the cancel coil 906 so as to pass/interrupt an electric current to the cancel coil 906.

When a recording paper sheet of a width smaller than a length of an effective portion of the heating tube 901 is passed, the cancel coil 906 is short-circuited. Therefore, by a change in magnetic flux that is generated in the core 905 by the excitation coil 904, an induction electromotive force is generated in the loop portions 906*a* and 906*b* of the cancel coil 906, and thus an induced current is generated in the cancel coil 906. In FIG. 23, arrows indicate the directions of an induced current generated in the cancel coil 906 at a particular moment. This induced current causes a magnetic flux to be generated in the loop portions 906*a* and 906*b*, which is in a direction opposite to that of the magnetic flux generated in the core 905 by the excitation coil 904. Thus, an amount of heat generated in both end portions of the heating tube 901 is suppressed.

On the other hand, in the case where a large-width recording paper sheet is passed, the cancel coil 906 is opened. Therefore, an induced current is not generated in the cancel coil 906, and thus an amount of heat generated in both the end portions of the heating tube 901 is not suppressed.

As described above, a distribution of an amount of heat generated in the width direction can be regulated so as to correspond to a width of a recording paper sheet.

However, the image heating device disclosed in JP2001-60490 A presents the following problems.

In this configuration, the cancel coil 906 needs to be wound so as to form the loop portions 906*a* and 906*b* at both the end portions in the width direction, while the loop portions 906*a* and 906*b* away from each other at both ends need to be coupled. Further, the complexity of the shape requires complicated winding work. For reasons including the above-mentioned reasons, this configuration results in a costly device. Moreover, when the cancel coil 906 is brought into conduction, magnetic flux generated by the excitation coil 904 does not pass through the core 905 and thus is diffused into a wide area, thereby causing unintended heating of a constituent member.

SUMMARY OF THE INVENTION

The present invention is to solve these problems with the conventional image forming devices. That is, a first object of the present invention is to provide an image heating device that can regulate an amount of heat generated in a width direction using a simple configuration at a reduced cost. Furthermore, a second object of the present invention is to provide an image heating device that prevents diffusion of magnetic flux generated by an excitation coil into a wide area. Moreover, the present invention is to provide a high-performance and less costly image forming apparatus including such an image heating device.

In order to achieve the above-mentioned objects, the present invention has the following configuration.

An image heating device according to the present invention includes a conductive heat generating member that transfers heat directly or indirectly to a body to be heated that is allowed to travel while carrying an image, an excitation unit that is provided close to the heat generating member and generates magnetic flux so as to cause the heat generating member to generate heat by electromagnetic induction, and a heat generation suppressing unit that suppresses heat generation of the heat generating member by regulating the magnetic flux generated by the excitation unit. In the image heating device, the heat generation suppressing unit suppresses heat generation of the heat generating member in a region corresponding to a region including at least a center portion of the body to be heated in a width direction.

Furthermore, an image forming apparatus according to the present invention includes the above-mentioned image heating device according to the present invention. In the image forming apparatus, the image heating device fixes a toner image carried by a recording paper sheet.

DESCRIPTION OF THE PREFERRED EMBODIMENTS

Figure 1:
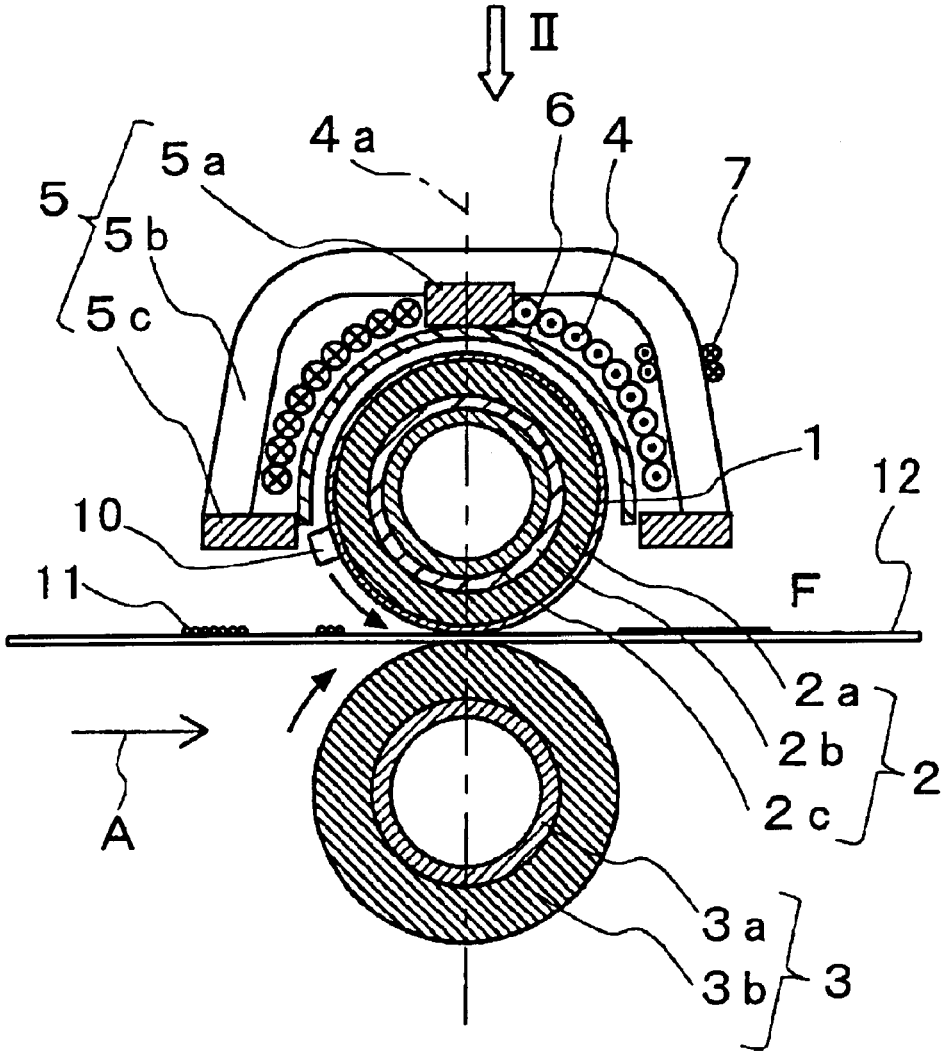
FIG. 1 is a side view in cross section of an image heating device according to Embodiment 1 of the present invention.

In the image heating device according to the present invention, the heat generation suppressing unit suppresses heat generation of the heat generating member in a region corresponding to a region including at least a center portion of a body to be heated in the width direction. According to this configuration, an amount of heat generated in a width direction can be regulated so as to have an arbitrary distribution corresponding to a width of a body to be heated and a temperature of the heat generating member. Moreover, the heat generation suppressing unit suppresses heat generation of the heat generating member in a center portion in the width direction, thereby allowing a simplified configuration and a reduced cost to be achieved. Further, in the case where the heat generation suppressing unit is operated, diffusion of magnetic flux into a wide area can be prevented.

Preferably, in the image heating device according to the present invention, bodies to be heated of varying dimensions in the width direction are allowed to travel such that a center position of each of the bodies to be heated in the width direction coincides with a common position substantially at a center of the heat generating member. That is, preferably, passing of paper sheets is performed by a so-called center reference method. According to this configuration, regardless of a width of a body to be heated, a temperature distribution in a width direction is made substantially symmetrical with respect to the center, and thus a system including the heat generation suppressing unit for controlling a temperature in the width direction can be simplified.

Preferably, the heat generation suppressing unit cancels out at least part of the magnetic flux generated by the excitation unit using an electric current induced by an induction electromotive force that is generated due to the magnetic flux generated by the excitation unit. According to this configuration, the heat generation suppressing unit according to the present invention can be formed easily at a reduced cost.

Preferably, the excitation unit includes a plurality of cores that are arranged at a distance from each other in the width direction and an excitation coil, and a distance between the adjacent cores in a center portion in the width direction is smaller than a distance between the adjacent cores in each of end portions in the width direction. According to this configuration, an amount of heat generated in the center portion in the width direction can be increased. Therefore, even in the case where recording materials of a small width are passed continuously, a constant temperature distribution can be maintained over the entire width. Moreover, in the case where the heat generation suppressing unit is operated, while diffusion of magnetic flux into a wide area is prevented, a constant temperature distribution in the width direction can be maintained.

Furthermore, preferably, the excitation unit includes a plurality of cores that are arranged at a distance from each other in the width direction and an excitation coil, and of the plurality of cores, at least the core positioned in a center portion in the width direction is moved by the heat generation suppressing unit. According to this configuration, in the case where the heat generation suppressing unit is operated, while diffusion of magnetic flux into a wide area is prevented, a constant temperature distribution in the width direction can be maintained.

Furthermore, the excitation unit includes a plurality of cores that are arranged in the width direction and an excitation coil, and the core arranged in a center portion in the width direction may have a magnetic permeability higher than a magnetic permeability of the core arranged in each of end portions in the width direction. Alternatively, a cross sectional area in a plane orthogonal to the magnetic flux of the core arranged in a center portion in the width direction may be larger than a cross sectional area in the plane orthogonal to the magnetic flux of the core arranged in each of end portions in the width direction. According to these configurations, in the case where the heat generation suppressing unit is operated, while diffusion of magnetic flux into a wide area is prevented, a constant temperature distribution in the width direction can be maintained.

Furthermore, preferably, the heat generation suppressing unit includes a loop-shaped conductor that links to at least part of the magnetic flux generated by the excitation unit and a switching unit that makes/interrupts electrical connection to a loop of the conductor. According to this configuration, the heat generation suppressing unit can be formed so as to be reduced in size using a reduced amount of a conductor.

Preferably, in this case, the loop-shaped conductor is disposed so that a region in which the body to be heated of a small width is passed is overlapped with at least part of the conductor. According to this configuration, a configuration of the heat generation suppressing unit can be simplified, and in the case where the heat generation suppressing unit is operated, diffusion of magnetic flux into a wide area can be prevented.

Furthermore, preferably, when a body to be heated of a small width is passed, the switching unit opens the loop of the conductor. According to this configuration, with a constant driving current passed through the excitation coil, a total amount of magnetic flux generated by the excitation coil is increased, and thus the inductance of the excitation coil increases, thereby increasing the load impedance of the excitation coil. As a result, an amount of the driving current is decreased. Thus, when a body to be heated that has a small width is passed and it is necessary to reduce an amount of heat generated, it is made easier to control a driving current.

Furthermore, preferably, the excitation unit includes an excitation power source that generates an electric current varying with time and an excitation coil that is supplied with an electric current by the excitation power source, and when an electric current induced in the loop of the conductor has a value in the vicinity of 0, the switching unit is switched over. According to this configuration, at a moment when an electric current of the same waveform as that of a high-frequency current fed to the excitation coil, which is induced in the loop of the conductor due to the high-frequency current, has a value of substantially 0, switching of the switching unit can be performed. Thus, the generation of an excessively high voltage in the switching unit that passes/interrupts an electric current to the loop of the conductor is suppressed, thereby allowing the occurrence of sparking and insulation destruction to be prevented. At the same time, an abrupt change in electric current and voltage is prevented from being caused in the loop of the conductor due to switching of the switching unit, and thus the generation of unwanted electromagnetic wave noise also can be prevented.

Furthermore, preferably, the excitation unit includes an excitation power source that generates an electric current varying with time and an excitation coil that is supplied with an electric current by the excitation power source, and when a voltage induced in the loop of the conductor has a value in the vicinity of 0, the switching unit is switched over. According to this configuration, at a moment when a voltage of the same waveform as that of a high-frequency current fed to the excitation coil, which is induced in the loop of the conductor due to the high-frequency current, has a value of substantially 0, switching of the switching unit can be performed. Thus, the generation of an excessively high voltage in the switching unit that passes/interrupts an electric current to the loop of the conductor is suppressed, thereby allowing the occurrence of sparking and insulation destruction to be prevented. At the same time, an abrupt change in electric current and voltage is prevented from being caused in the loop of the conductor due to switching of the switching unit, and thus the generation of unwanted electromagnetic wave noise also can be prevented.

Preferably, in the above-mentioned case, when the switching unit is switched over, an electric current is not applied to the excitation coil. According to this configuration, in a state where an electric current or a voltage of the same waveform as that of a high-frequency current fed to the excitation coil, which is induced in the loop of the conductor due to the high-frequency current, has a value of 0, switching of the switching unit can be performed.

Furthermore, preferably, the excitation unit includes an excitation power source that generates an electric current varying with time and an excitation coil that is supplied with an electric current by the excitation power source, and the switching unit is switched over in synchronization with a change in an electric current or a voltage of the excitation coil. According to this configuration, even during the application of a high-frequency current to the excitation coil, at a moment when an electric current or a voltage of the same waveform as that of a high-frequency current fed to the excitation coil, which is induced in the loop of the conductor due to the high-frequency current, has a value of substantially 0, switching of the switching unit can be performed.

Furthermore, preferably, the conductor forms a plurality of loops, and at least one of the plurality of loops links to magnetic flux that does not link to the other loops. According to this configuration, magnetic fluxes in different positions can be controlled by switching of a single switching unit. Thus, controlling can be performed more precisely using a reduced number of switching units, thereby allowing a uniform temperature distribution to be realized.

Furthermore, preferably, the loop of the conductor is inclined with respect to magnetic flux linking to the loop of the conductor. Herein, "the loop of the conductor is inclined with respect to magnetic flux" means that a plane including the loop of the conductor intersects magnetic flux passing through the loop at an angle other than 90 degrees. According to this configuration, a heat generation suppressing function of the heat generation suppressing unit can be changed continuously. Thus, controlling an amount of heat generated can be performed even more precisely, thereby allowing an arbitrary temperature distribution to be realized in the width direction.

Next, the image forming apparatus according to the present invention includes the above-mentioned image heating device according to the present invention. According to this configuration, an amount of heat generated in the width direction can be regulated so as to have an arbitrary distribution corresponding to a width of a body to be heated and a temperature of the heat generating member. Moreover, the heat generation suppressing unit suppresses an amount of heat generated in the heat generating member in a center portion in the width direction, thereby allowing a simplified configuration and a reduced cost to be achieved. Further, in the case where the heat generation suppressing unit is operated, diffusion of magnetic flux into a wide area can be prevented.

Hereinafter, the image heating device and the image forming apparatus according to the present invention will be described in detail with reference to the appended drawings.

(Embodiment 1)

Figure 8:
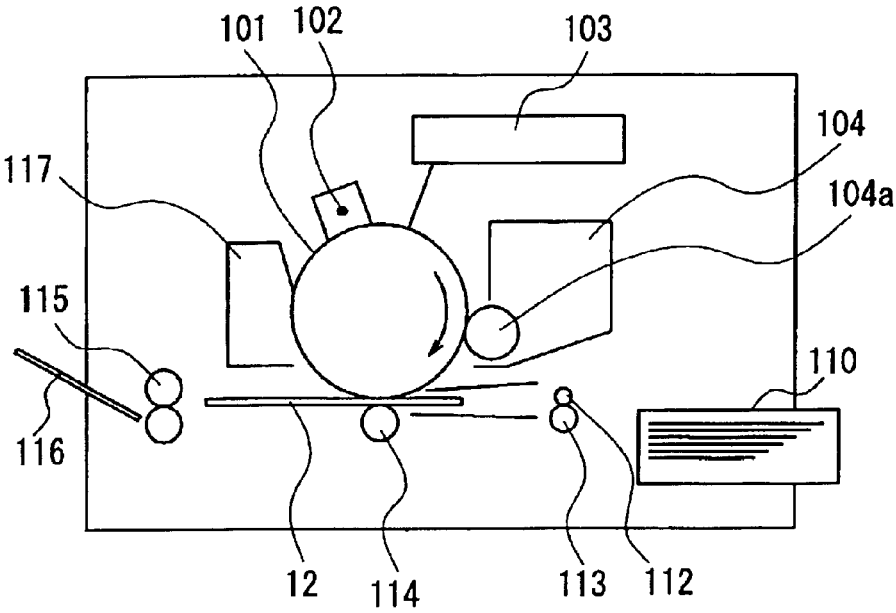
FIG. 8 is a cross sectional view schematically showing an example of a configuration of an image forming apparatus using the image heating device according to Embodiment 1 of the present invention as a fixing device.

FIG. 8 is a cross sectional view schematically showing an example of a configuration of an image forming apparatus using an image heating device according to Embodiment 1 of the present invention as a fixing device. In the following description, the configuration and an operation of this apparatus will be explained.

Reference numeral 101 denotes an electrophotographic photoreceptor (hereinafter, referred to as a "photosensitive drum"). The photosensitive drum 101, while being driven to rotate at a predetermined peripheral velocity in a direction indicated by an arrow, has its surface charged uniformly to a predetermined potential by a charger 102.

Reference numeral 103 denotes a laser beam scanner that outputs a laser beam modulated so as to correspond to a time-series electric digital pixel signal of image information input from a host apparatus such as an image reading apparatus, a computer or the like, which is not shown in the figure. The surface of the photosensitive drum 101 charged uniformly as described above is selectively scanned by and exposed to this laser beam, and thus a static latent image corresponding to the image information is formed on the surface of the photosensitive drum 101.

Next, this static latent image is supplied with charged powdered toner by a developer 104 including a developing roller 104*a* that is driven to rotate, and is made manifest as a toner image.

Meanwhile, a recording paper sheet 12 is fed one at a time from a paper feeding part 110. The recording paper sheet 12 is passed though a pair of resist rollers 112 and 113 and then conveyed to a transferring part composed of the photosensitive drum 101 and a transferring roller 114 that is in contact with the photosensitive drum 101. The timing thereof is appropriate and synchronized with the rotation of the photosensitive drum 101. By a function of the transferring roller 114 to which a transfer bias voltage is applied, toner images on the photosensitive drum 101 are transferred one after another to the recording paper sheet 12. The recording paper sheet 12 that has been passed through the transferring part is released from the photosensitive drum 101 and introduced to an image heating device 115 where fixing of the transferred toner image is performed. The recording paper sheet 12 on which the image is fixed by the fixing process is output to a paper ejecting tray 116.

The surface of the photosensitive drum 101 from which the recording paper sheet 12 has been released is cleaned by removing residual materials such as toner remaining thereon after the transferring process by a cleaning device 117 and used repeatedly for successive image formation.

The following is a detailed description of the image heating device 115 used in the above-mentioned image forming apparatus.

Figure 2:
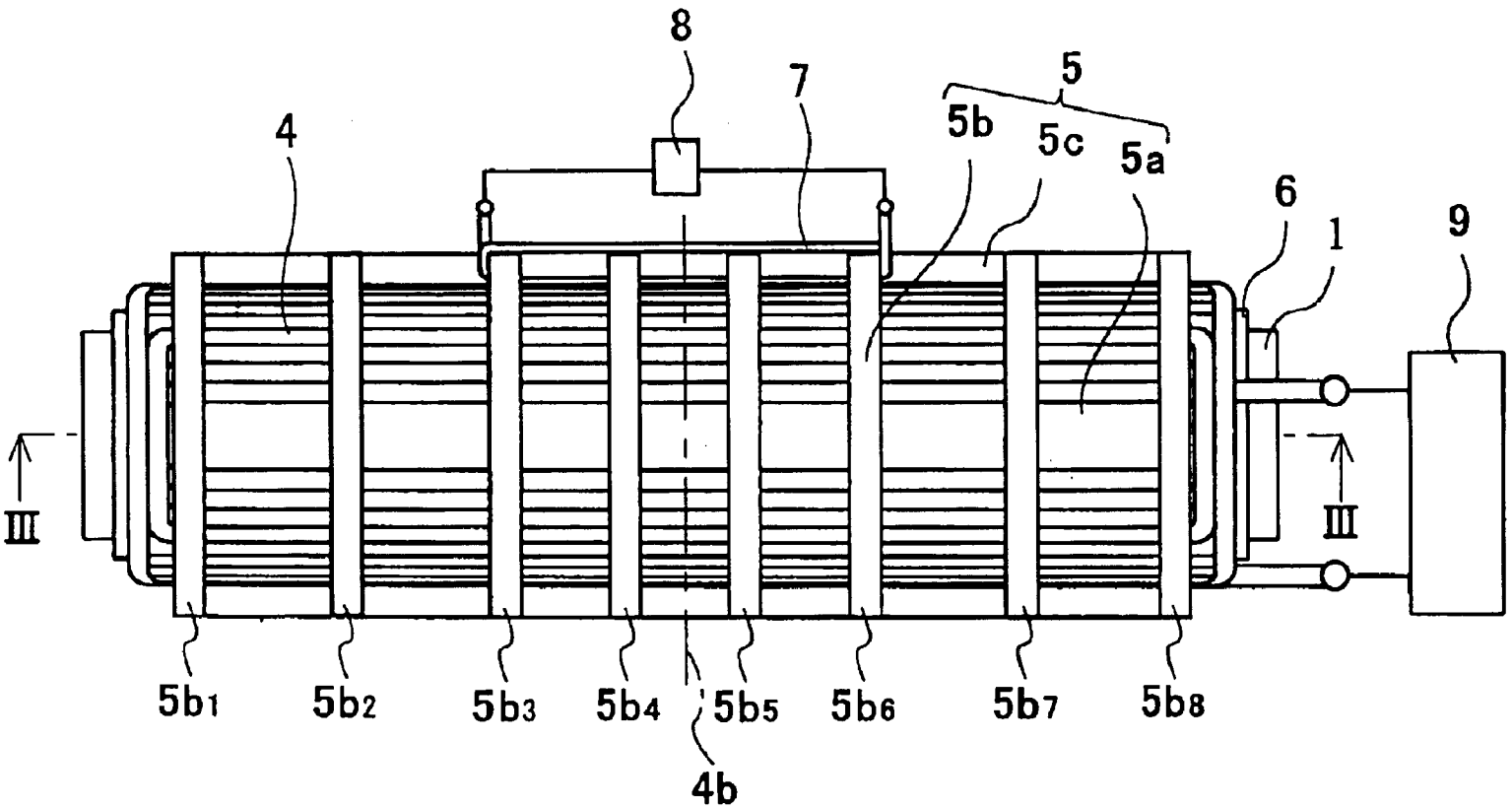
FIG. 2 is a rear view of a heat generating part as seen from a direction indicated by an arrow II of FIG. 1.
Figure 3:
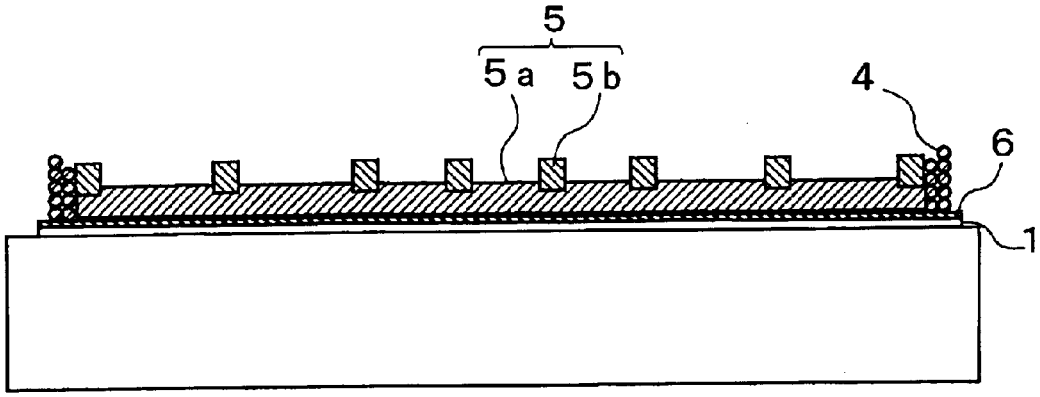
FIG. 3 is a cross sectional view in perspective of the heat generating part taken on line III—III of FIG. 2.
Figure 4:
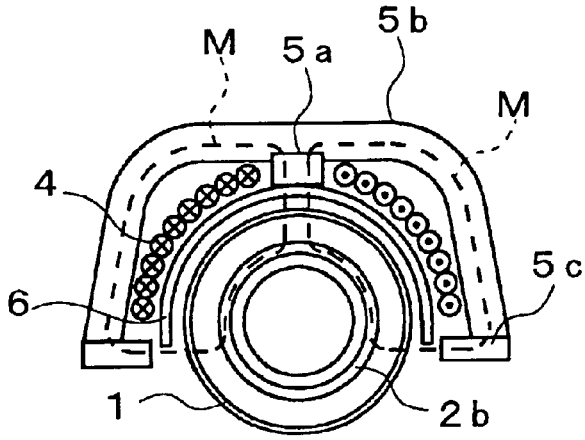
FIG. 4 is a diagram for explaining a heat generating function of the image heating device according to Embodiment 1 of the present invention.
Figure 5:
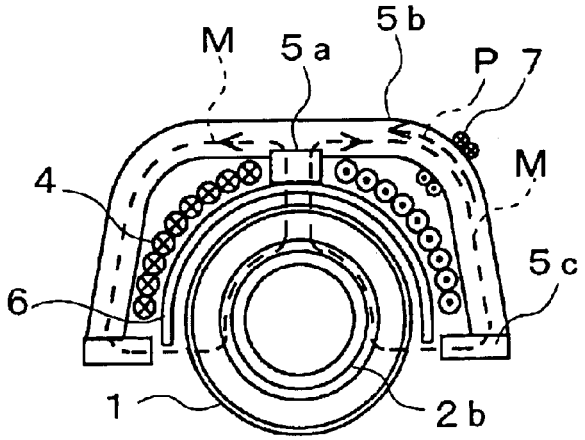
FIG. 5 is a diagram for explaining a heat generation suppressing function performed by a heat generation suppressing unit according to Embodiment 1 of the present invention.
Figure 6:
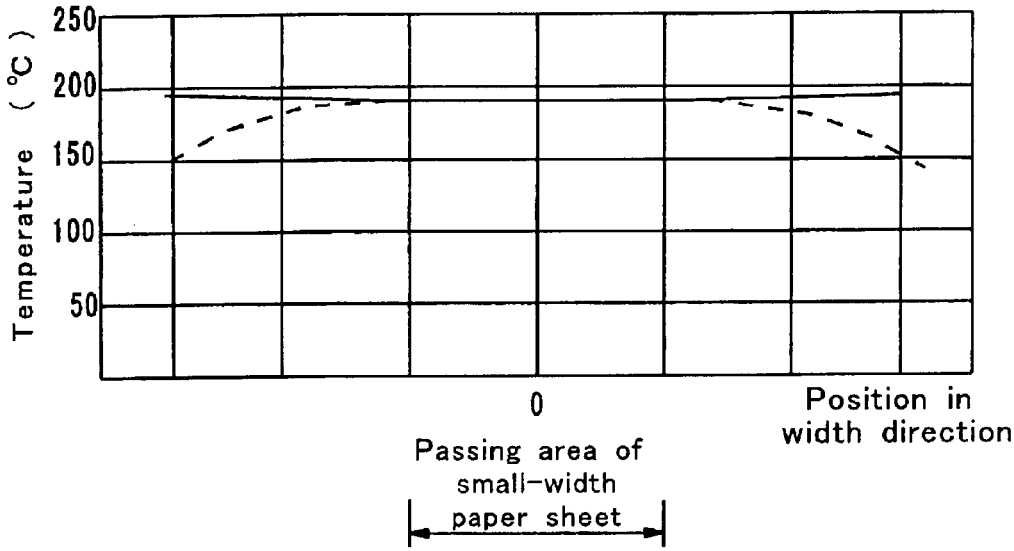
FIG. 6 is a graph showing a temperature distribution of the image heating device according to Embodiment 1 of the present invention in a rotation axis direction.
Figure 7:
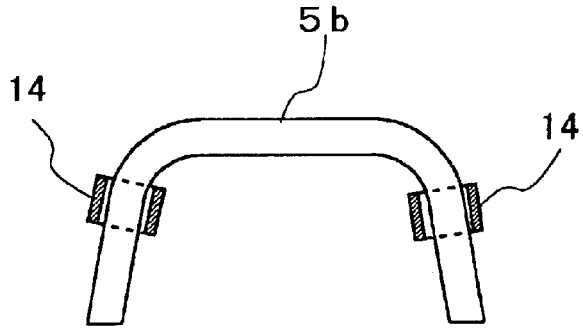
FIG. 7 is a cross sectional view showing another example of a configuration of the heat generation suppressing unit according to Embodiment 1 of the present invention.

FIG. 1 is a side view in cross section of the image heating device according to Embodiment 1 of the present invention, and FIG. 2 is a rear view of a heat generating part as seen from a direction indicated by an arrow II of FIG. 1. FIG. 3 is a cross sectional view in perspective of the heat generating part taken on line III—III (a plane including a rotation axis of a heat generating tube 1 and a winding center axis 4*a* of an excitation coil 4) of FIG. 2, and FIG. 4 is a diagram for explaining a heat generating function. FIG. 5 is a diagram for explaining a heat generation suppressing function performed by a heat generation suppressing unit, FIG. 6 is a graph showing a temperature distribution of the heat generating tube 1 in a rotation axis direction (width direction), and FIG. 7 is a cross sectional view showing another form of the heat generation suppressing unit as an example.

Reference numeral 1 denotes the heat generating tube as a heat generating member. The heat generating tube 1 is fitted externally on a cylindrical fixing roller 2 and supported rotatably. The heat generating tube 1 has an outer diameter of 30 mm and can be formed of a conductive material having flexibility, examples of which include an about 40-$\mu$m thick material of nickel or stainless steel or a 100-$\mu$m thick material of polyimide in which a powder of a conductive material is dispersed. On an outer surface of the heat generating tube 1, a 150-$\mu$m thick silicone rubber layer for imparting elasticity that has a hardness of JIS A25 degrees, and a 20-$\mu$m thick mold releasing layer of a fluorocarbon resin for imparting mold releasability are laminated outwardly in this order. The material of the mold releasing layer is not limited to a fluorocarbon resin, and the mold releasing layer may be formed by coating of a single material or a combination of materials selected from resin or rubber materials having excellent mold releasability such as PTFE (polytetrafluoroethylene), PFA (tetrafluoroethylene-perfluoroalkylvinyl ether copolymer), FEP (tetrafluoroethylene hexafluoropropylene copolymer) and the like.

The fixing roller 2 is composed of a metallic core 2*c* of carbon steel as an innermost layer, a 1-mm thick magnetism shielding layer 2*b* that is provided on an outer side of the metallic core 2*c* and has a relative magnetic permeability of 40, and a 5-mm thick silicone sponge layer 2*a* that is provided on an outer side of the magnetism shielding layer 2*b* and has a hardness of Asker-C45 degrees. The magnetism shielding layer 2*b* is formed of a heat-resistant resin material of polyimide, silicone rubber or the like in which ferrite powder or iron powder whose surface is insulated is dispersed.

Reference numeral 3 denotes a pressing roller as a pressing unit. The pressing roller 3 has a surface layer of silicone rubber having a hardness of JIS A60 degrees and is in contact under pressure with the heat generating tube 1, so that a nip part is formed between the pressing roller 3 and the heat generating tube 1. The pressing roller 3 is driven to rotate by a driving unit of a main body of the apparatus, which is not shown in the figures. The heat generating tube 1 and the fixing roller 2 are rotated following the rotation of the pressing roller 3. In order to enhance abrasion resistance and mold releasability, a surface of the pressing roller 3 may be coated with a single material or a combination of materials selected from resin or rubber materials of PFA, PTFE, FEP and the like.

Reference numeral 4 denotes an excitation coil as an excitation unit. The excitation coil 4 includes nine turns of a wire bundle composed of 100 wires of a copper wire with its surface insulated that has an outer diameter of 0.15 mm.

The wire bundle of the excitation coil 4 is arranged, at end portions of a cylindrical face of the heat generating tube 1 in a direction of the rotation axis (not shown), in the form of an arc along outer peripheral faces of the end portions. The wire bundle is arranged, in a portion other than the end portions, along a direction of a generatrix of the cylindrical face. As shown in FIG. 1, which is a cross section orthogonal to the rotation axis of the heat generating tube 1, the wire bundle of the excitation coil 4 is arranged tightly without being overlapped (except at end portions of the heat generating tube 1) on an assumed cylindrical face formed around the rotation axis of the heat generating tube 1 so as to cover the cylindrical face of the heat generating tube 1. Further, as shown in FIG. 3, which is a cross section including the rotation axis of the heat generating tube 1, in portions opposed to the end portions of the heat generating tube 1, the wire bundle of the excitation coil 4 is overlapped in two rows and thus forced into bulges. Thus, the whole excitation coil 4 is formed into a saddle-like shape. The winding center axis 4*a* of the excitation coil 4 is a straight line substantially orthogonal to the rotation axis of the heat generating tube 1, which passes through substantially a center point of the heat generating tube 1 in the rotation axis direction. The excitation coil 4 is formed so as to be substantially symmetrical with respect to the winding center axis 4*a*. The wire bundle is wound so that adjacent turns of the wire bundle are bonded to each other with an adhesive applied to their surface, thereby maintaining the shape shown in the figure.

Reference numeral 5 denotes a core formed from ferrite that is a material having a high magnetic permeability. The core 5 is composed of a bar-like central core 5*a* that intersects the winding center axis 4*a* of the excitation coil 4 and is disposed parallel to the rotation axis of the heat generating tube 1, a substantially arch-shaped (substantially U-shaped) arch core 5*b* that is disposed on a side opposite to a side of the heat generating tube 1 with respect to the excitation coil 4 at a distance from the excitation coil 4, and a pair of bar-like end cores 5*c* that are disposed parallel to the rotation axis of the heat generating tube 1. As shown in FIGS. 2 and 3, a plurality of the arch cores 5*b* are arranged at a distance from each other in the rotation axis direction of the heat generating tube 1. As shown in FIG. 1, the central core 5*a* is disposed inside an opening in a center portion of the wound excitation coil 4. Further, the pair of end cores 5*c* are connected respectively to both ends of each of the arch cores 5*b* and opposed to the heat generating tube 1 without the excitation coil 4 interposed between them. The central core 5*a*, the arch cores 5*b* and the end cores 5*c* are coupled magnetically.

In this embodiment, eight arch cores 5*b* are arranged at a distance from each other in the rotation axis direction of the heat generating tube 1. As shown in FIG. 2, letting the arch cores 5*b* be denoted as 5*b*1, 5*b*2, . . . , 5*b*8 in the order starting from the left, the arch cores 5*b* 1 to 5*b*3 and the arch cores 5*b*6 to 5*b*8 on both ends are spaced at a distance of 20 mm from each other, and the arch cores 5*b*3 to 5*b*6 in a center portion are spaced at a distance of 10 mm from each other. All of the arch cores 5*b* are equal in dimensions and have a width (dimension in the rotation axis direction of the heat generating tube 1) of 6 mm. The central core 5*a* and the end cores 5*c* have a cross sectional area of 4 mm by 6 mm.

As a material of the core 5, as well as ferrite, a material such as a silicon steel plate or the like that has a high magnetic permeability and a high resistance is used desirably. However, a material having a somewhat low magnetic permeability can be used as long as the material is a magnetic material. Further, the central core 5*a* and the end cores 5*c* may be formed by being divided into a plurality of portions in a longitudinal direction.

Reference numeral 6 denotes a coil holding member of 2 mm thickness that is formed from a heat resistant resin such as PEEK (polyether ether ketones), PPS (polyphenylene sulfide) or the like. The excitation coil 4 and the core 5 are bonded to the coil holding member 6, thereby maintaining the shape shown in the figures.

Reference numeral 7 denotes a suppressing coil as a heat generation suppressing unit. The suppressing coil 7 is formed of wires of a copper wire with its surface insulated. As shown in FIG. 2, the suppressing coil 7 is wound with two turns around the four arch cores 5*b*3 to 5*b*6 in the center so as to bridge between the arch core 5*b*3 and the arch core 5*b*6. Further, as shown in FIG. 1, the suppressing coil 7 is wound only on one side of the arch cores 5*b* with respect to the central core 5*a*.

Reference numeral 8 denotes a relay that makes/interrupts electrical connection across the suppressing coil 7. The relay 8 can be formed of a switching element such as a power transistor, a relay having a contact or the like. This relay 8 is switched over before an operation so as to correspond to a type and a width of a recording paper sheet to be passed next.

An alternating current having a maximum current amplitude of 60 A and a maximum voltage amplitude of 600 V at 30 kHz is applied to the excitation coil 4 from an excitation circuit 9 that is a voltage resonant inverter. A temperature sensor 10 is provided at a center portion of the heat generating tube 1 in the rotation axis direction so as to be opposed to the heat generating tube 1. Based on a temperature signal from this temperature sensor 10, an alternating current to be applied to the excitation coil 4 is controlled so that the temperature of a surface of the heat generating tube 1 is 170 degrees centigrade, which is a set fixing temperature.

In the image forming apparatus including the image heating device having the above-mentioned configuration, a toner image is formed on an outer surface of the photosensitive drum 101 (see FIG. 8), and a toner image 11 thus formed is transferred to a surface of the recording paper sheet 12. Then, as shown in FIG. 1, the recording paper sheet 12 is allowed to enter the nip part from a direction indicated by an arrow A so that fixing of the toner image 11 on the recording paper sheet 12 is performed, thereby allowing a recorded image to be obtained.

In this embodiment, the above-mentioned excitation coil 4 causes the heat generating tube 1 to generate heat by electromagnetic induction. Hereinafter, this function will be described with reference to FIG. 4.

As indicated by a broken line in FIG. 4, magnetic flux M generated by the excitation coil 4 due to an alternating current from the excitation circuit 9 penetrates the heat generating tube 1 from the end core 5*c* of the core 5 and enters the magnetism shielding layer 2*b* of the fixing roller 2. Then, due to magnetism of the magnetism shielding layer 2*b*, the magnetic flux M passes through the magnetism shielding layer 2*b* in a circumferential direction. After that, the magnetic flux M penetrates the heat generating tube 1 again, enters the central core 5*a* of the core 5, and passes through the arch core 5*b* so as to reach the end core 5*c*. In each of the arch cores 5*b*, a pair of such magnetic fluxes M in the form of a loop are formed so as to be substantially symmetrical with respect to the central core 5*a*. These pairs of magnetic fluxes M are generated and disappear repeatedly due to an alternating current of the excitation circuit 9. An induced current generated by a change in this magnetic flux M passes through the heat generating tube 1, so that Joule heat is generated. The central core 5*a* and the end cores 5*c* that are continuous in the rotation axis direction of the heat generating tube 1 have a function of dispersing magnetic flux that has passed through the arch core 5*b* in the rotation axis direction so as to obtain a uniform magnetic flux density.

Next, a function of the suppressing coil 7 will be described with reference to FIG. 5. By supplying a high-frequency current to the excitation coil 4, at a particular moment, a change is caused in magnetic flux in a direction indicated by an arrow M. When this magnetic flux M passes through the arch cores 5*b*, an induction electromotive force is induced in the suppressing coil 7 wound on an outer periphery of the arch cores 5*b* by the change in the magnetic flux M. In the case where the relay 8 is in a connected state, due to this induced voltage, an electric current passes through the suppressing coil 7. Due to the electric current in the suppressing coil 7, magnetic flux P, in a direction in which a change in the magnetic flux M generated by the excitation coil 4 is cancelled out, is generated. As a result, the magnetic flux M is suppressed. Thus, heat generation is suppressed in a portion of the heat generating tube 1 corresponding to the four arch cores 5*b*3 to 5*b*6 in the center (see FIG. 2) around which the suppressing coil 7 is wound.

The description is directed next to an operation performed in the case where the recording paper sheets 12 of varying widths (dimension in the rotation axis direction of the heat generating tube 1) are passed continuously. In the image heating device according to this embodiment, even in the case where recording paper sheets to be passed vary in width, each of the recording paper sheets is passed such that a center of the recording paper sheet in a width direction always coincides with a center position 4*b* (see FIG. 2) of the heat generating tube 1 in the rotation axis direction (hereinafter, this way of passing paper sheets is referred to as "a center reference method"). Thus, a small-width recording paper sheet is passed only in the center portion.

FIG. 6 shows a temperature distribution of the heat generating tube 1 in the rotation axis direction. In FIG. 6, a vertical axis indicates a temperature and a horizontal axis indicates a position in the rotation axis direction of the heat generating tube 1. The position indicated by "0" on the horizontal axis corresponds to the center position 4*b* (see FIG. 2) in the rotation axis direction of the heat generating tube 1. In the graph, a solid line indicates a temperature distribution obtained in the case where small-width paper sheets are passed continuously with the relay 8 in an open state. Further, a broken line indicates a temperature distribution obtained in the case where heating is performed so as to attain a predetermined temperature with the relay 8 in the open state while no paper sheet is passed.

The description is directed first to the temperature distribution that is obtained when the relay 8 is in the open state and indicated by the broken line. The magnetic flux M on a side opposite to a side of the heat generating tube 1 with respect to the excitation coil 4 passes through the arch cores 5*b*, and thus magnetic flux that penetrates the heat generating tube 1 is likely to be concentrated at portions opposed to the arch cores 5*b*. In this embodiment, as shown in FIG. 2, the four arch cores 5*b*3 to 5*b*6 in the center portion are spaced from each other at a distance smaller than a distance at which the arch cores 5*b*1 to 5*b*3 and the arch cores 5*b*6 to 5*b*8 on both outer sides of the arch cores 5*b*3 to 5*b*6 are spaced from each other. Therefore, a distribution of an amount of heat generated in the heat generating tube 1 in the rotation axis direction is such that an amount of heat generated is likely to be larger in the center portion where the arch cores 5*b* are spaced at a smaller distance from each other. In this embodiment, the sensor 10 for temperature control is placed at the center portion of the heat generating tube 1 in the rotation axis direction. Therefore, as indicated by the broken line in FIG. 6, the center portion is heated to a set temperature, while this temperature is not attained at the end portions.

When passing a maximum-width recording paper sheet, the relay 8 for the suppressing coil 7 provided on the four arch cores 5*b*3 to 5*b*6 in the center portion is switched to the connected state. When heating is performed in this state, magnetic flux that passes through the four arch cores 5*b*3 to 5*b*6 on which the suppressing coil 7 is provided is decreased, so that heat generation in the center portion is suppressed. Thus, as indicated by the solid line in FIG. 6, the distribution of an amount of heat generated can be made uniform over the entire width of the heat generating tube 1, thereby allowing the whole heat generating tube 1 to be maintained at substantially a uniform temperature.

Next, when passing a small-width recording paper sheet, the relay 8 is switched to the open state. When an electric current is supplied to the excitation coil 4 in this state, as described above, in the center portion, since the arch cores 5*b* are spaced at a smaller distance from each other, magnetic flux is concentrated, and thus a larger amount of heat is generated. However, the recording paper sheet is passed in this center portion and thus removes heat therefrom. On the other hand, at both the ends without the suppressing coil 7, although no paper sheet is passed, since the arch cores 5*b* are spaced originally at a larger distance from each other, an amount of magnetic flux is small, and thus an amount of heat generated is small. Therefore, a temperature rise of the heat generating tube 1 in non-paper passing regions at both the ends is suppressed. As a result of this, both the end portions where heat is not removed by a paper sheet can be kept at substantially the same temperature as a temperature in the center portion. Thus, as indicated by the solid line in FIG. 6, the heat generating tube 1 can be maintained at substantially a uniform temperature over the entire width. Further, even when a maximum-width recording paper sheet is passed immediately afterward, heating can be performed uniformly in the width direction, thereby allowing an excellent image to be formed.

As described above, when passing small-width paper sheets continuously, the relay 8 is brought to the open state, and therefore the generation of an excessively large amount of heat in the non-paper passing regions at both the ends of the heat generating tube 1 can be suppressed. Thus, in end portions, bearings and the like of the heat generating tube 1, the fixing roller 2 and the pressing roller 3, breakage or deterioration can be prevented from occurring due to a temperature rise to a temperature above a temperature that they can withstand.

Meanwhile, in the case where a temperature is raised with the relay 8 opened while no paper sheet is passed, in the heat generating tube 1, a larger amount of heat is generated in the center portion than in both the end portions. Therefore, as indicated by a dotted line in FIG. 6, the temperature is highest in the center portion. However, the temperature sensor 10 for temperature control is placed at the center portion, and thus an excessive temperature rise in the center portion is prevented.

Figure 23:
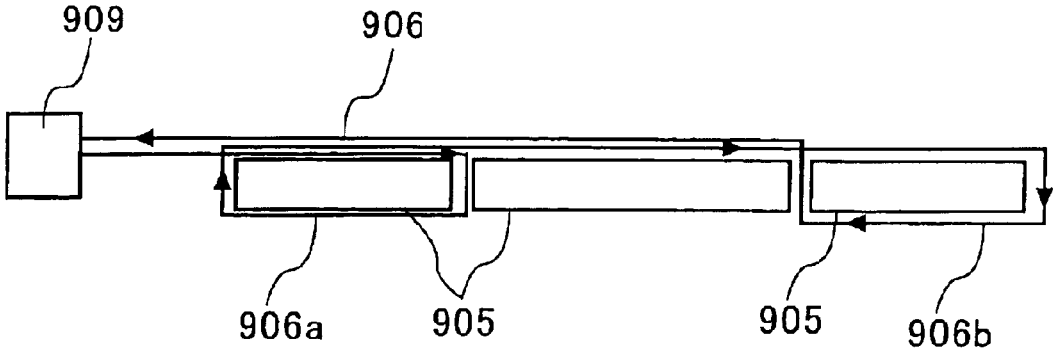
FIG.23 PRIOR ART
FIG. 23 is a plan view of a cancel coil provided in the image heating device shown in FIG. 22 as seen from a direction indicated by an arrow S.

In this embodiment, when passing a small-width paper sheet, the relay 8 is opened. In contrast to this, in the conventional image heating device shown in FIG. 23, when passing a small-width paper sheet, the switching element 909 is switched on. As in the conventional technique, when the switching element 909 is switched on in passing a small-width paper sheet, with a constant driving current applied to the excitation coil 904, a total amount of magnetic flux generated by the excitation coil 904 is decreased. Therefore, the inductance of the excitation coil 904 decreases, thereby decreasing the load impedance of the excitation coil 904 with respect to the excitation circuit. This raises a possibility that an amount of a driving current that passes through the excitation coil 904 is increased, so that an amount of heat generated is increased. As described above, in the configuration shown in FIG. 23, when a small-width paper sheet is passed, while it is necessary to reduce an amount of heat generated, an amount of a driving current that passes through the excitation coil 904 is likely to be increased. This raises a necessity for an electric current controlling circuit that controls an increase in the driving current. Moreover, in this case, since a change in a target value of an amount of heat generated has a phase opposite to that of a change in an amount of heat generated caused by a variation in load impedance, a wide control range of the electric current is required. Thus, in order to realize such controlling, a complex and expensive device is required. In addition, in the case where this electric current controlling circuit does not operate properly, there is a possibility that a breakdown is caused in the excitation circuit and the excitation coil 904 due to an excessively large electric current.

In contrast to this, in this embodiment, when passing a small-width paper sheet, the relay 8 is opened so that an electric current to the suppressing coil 7 is interrupted. Thus, with a constant driving current applied to the excitation coil 4, a total amount of magnetic flux generated by the excitation coil 4 is increased. Therefore, the inductance of the excitation coil 4 increases, thereby increasing the load impedance of the excitation coil 4 with respect to the excitation circuit 9. Thus, an amount of driving current that passes through the excitation coil 4 is decreased, thereby decreasing an amount of heat generated. As described above, in this embodiment, when a small-width paper sheet is passed and thus it is necessary to reduce an amount of heat generated, an amount of driving current that passes through the excitation coil 4 is decreased, so that an amount of heat generated also is decreased. Thus, unlike the conventional configuration, it is no longer necessary to use the electric current controlling circuit that controls a driving current. Even in the case where the use of the electric current controlling circuit is required, in controlling an electric current, a change in a target value of an amount of heat generated has the same phase as that of a change in an amount of heat generated caused by a variation in load, and thus a simplified configuration and a cost reduction of a device can be achieved. Moreover, even in the case where this electric current controlling circuit does not operate properly, when an amount of heat generated should be suppressed, a driving current is reduced automatically, and thus passing of an excessively large electric current is prevented. Further, a breakdown also is prevented from occurring in the excitation circuit 9 and the excitation coil 4 due to the excessively large electric current.

Furthermore, in this embodiment, passing of paper sheets is performed by the center reference method in which both types of paper sheets, i.e. a small-width paper sheet and a large-width paper sheet, are passed such that a center line of each of the paper sheets in a width direction coincides with the center position 4*b* (see FIG. 2) of the heat generating tube 1 in the rotation axis direction. Therefore, a temperature distribution of the heat generating tube 1 in the width direction can be made substantially symmetrical with respect to the center position 4*b*. This makes it easier to make the temperature distribution in the width direction uniform by placing one heat generation suppressing unit only in the center. Therefore, it is no longer necessary to use a plurality of the relays 8. Further, the simple shape of the suppressing coil 7 makes it easier to form the suppressing coil 7, thereby allowing a less costly configuration to be achieved.

In the case of passing recording paper sheets of varying sizes, in a method in which a recording paper sheet is passed such that one end portion thereof (reference end) always coincides with one end portion of the heat generating tube 1 (reference end), when a small-width paper sheet is passed, a non-paper passing region has an increased width (namely, a distance between an end portion of the heat generating tube 1 on a side opposite to a side of the reference end and an end portion of the recording paper sheet on a side opposite to a side of the reference end). Generally, heat in a paper passing region is transferred to a recording paper sheet, and heat at each of the end portions of the heat generating tube 1 is transferred to a bearing member or the like. Accordingly, the larger the width of the non-paper passing region, the more the excessive heating is likely to be caused in the non-paper passing region. In this embodiment, passing of paper sheets is performed by the center reference method, and thus when passing a small-width paper sheet, each of non-paper passing regions formed on both ends of the paper sheet can be reduced in width, thereby allowing an excessive temperature rise in the non-paper passing regions to be prevented. Thus, as described above, it is made easier to obtain a temperature distribution that is uniform in the width direction by the suppressing coil 7 provided in the center portion so as to correspond to a passing region of a small-width paper sheet.

Furthermore, in this embodiment, the relay 8 is switched over before passing of a recording paper sheet is started. This indicates that the relay 8 is switched over before the supply of an electric current to the excitation coil 4 is started. When passing a large-width paper sheet, after the relay 8 is switched to the connected state, the supply of an electric current to the excitation coil 4 is started. When passing a small-width paper sheet, after the relay 8 is switched to the open state, the supply of an electric current to the excitation coil 4 is started. This procedure is followed, and thus every time a switching operation of the relay 8 is performed, the excitation coil 4 is brought to a state of not having an electric current flow. Accordingly, when each of an electric current and a voltage that are generated in the suppressing coil 7 has a value of 0, the switching operation of the relay 8 is performed. Thus, when the relay 8 is switched over, an abrupt change in electric current and voltage is not caused, so that the generation of unwanted electromagnetic noise can be prevented.

In this case, the following configuration also may be possible. That is, the relay 8 is brought to the connected state before the supply of an electric current to the excitation coil 4 is started and during standby, and the relay 8 is switched over after a predetermined set temperature is attained.

Furthermore, in this embodiment, the suppressing coil 7 is wound such that the plurality of the arch cores 5*b*3 to 5*b*6 are wrapped externally. Thus, the configuration can be simplified more than in the case where the coil is wound on each of the arch cores, thereby achieving a reduced manufacturing cost.

The magnetic flux M on a side opposite to a side of the heat generating tube 1 with respect to the excitation coil 4 passes through the plurality of the arch cores 5*b*. Therefore, magnetic flux that penetrates the heat generating tube 1 in a wide area in the width direction can be controlled by providing the suppressing coil 7 on a limited number of the arch cores 5*b*. Thus, the distribution of an amount of heat generated can be controlled by the suppressing coil 7 that is compact in size.

Furthermore, in the rotation axis direction of the heat generating tube 1, the arch cores 5*b* are arranged at a distance from each other, and in a circumferential direction of the heat generating tube 1, the central core 5*a* and the end cores 5*c* are arranged at a distance from each other. Accordingly, a large opening is secured in the core 5. As a result, heat is not stored in the core 5, the excitation coil 4 and the suppressing coil 7. Therefore, the saturation flux density of ferrite of the core 5 can be prevented from decreasing due to a temperature rise caused by storing of heat, resulting in a sharp decrease in the magnetic permeability of the core 5 as a whole. Further, a short circuit between wires due to melting of insulating coatings of the wires can be prevented. Thus, the heat generating tube 1 can be maintained stably at a predetermined temperature for a long time.

Furthermore, in the present invention, the suppressing coil 7 is provided only on one side of the four arch cores 5*b*3 to 5*b*6 in the center with respect to the central core 5*a*. Therefore, by bringing the relay 8 to the connected state, only one of the pair of magnetic fluxes M that are generated in each of the arch cores 5*b*3 to 5*b*6 is suppressed by the suppressing coil 7 (see FIG. 5). That is, no influence is exerted on the other magnetic flux M generated in each of the arch cores 5*b*3 to 5*b*6. Moreover, the arch cores 5*b*3 to 5*b*6 on which the suppressing coil 7 is provided are set to be arranged at a distance from each other that is half the distance between the respective arch cores 5*b*1 to 5*b*3 and the respective arch cores 5*b*6 to 5*b*8 that are arranged in both the end portions. Thus, even if the relay 8 is brought to the connected state and thus the above-mentioned one of the magnetic fluxes M is hindered from passing through the arch cores 5*b*3 to 5*b*6, that does not cause the magnetic flux to be diffused into a wide area on a side opposite to a side of the heat generating tube 1 with respect to the arch cores 5*b*3 to 5*b*6. As a result of this, unintended heating of a peripheral member can be prevented.

Furthermore, the suppressing coil 7 is placed on the four arch cores 5*b*3 to 5*b*6 in the center in the width direction. Therefore, when the relay 8 is brought to the connected state, the magnetic flux M that has been hindered from passing through these arch cores 5*b*3 to 5*b*6 is dispersed in and passes through the arch cores 5*b*1 to 5*b*3 and the arch cores 5*b*6 to 5*b*8 in both end portions of the arch cores 5*b*3 to 5*b*6. Thus, when the relay 8 is brought to the connected state, bearings or the like at end portions can be prevented from being heated due to magnetic flux diffused into a wide area outside the core 5.

As described above, according to the present invention, members such as the heat generating tube 1, the fixing roller 2, the pressing roller 3, the bearings and the like can be prevented from being heated to a temperature above a temperature that the members can withstand due to an excessive temperature rise at both end portions from which heat is not removed by the recording paper sheet 12 of a small width, resulting in breakage or deterioration of the members. Moreover, even when a maximum-width recording paper sheet is passed right after small-width paper sheets are passed continuously, a uniform temperature distribution is maintained in a passing area of a maximum-width recording paper sheet of the heat generating tube 1, thereby allowing the occurrence of hot offset to be prevented.

The shape of the core 5 is not limited to the shape used in the above-mentioned example, i.e. the shape formed of a combination of a plurality of the substantially arch-shaped arch cores 5*b* of a uniform thickness, the central core 5*a* that couples these arch cores 5*b* together and the end cores 5*c*. For example, a core as one body that is continuous in the rotation axis direction of the heat generating tube 1, in which a plurality of holes are provided and the suppressing coil 7 is formed by passing a wire bundle thereof through the holes, also may be used.

Furthermore, the configuration of the suppressing coil 7 is not limited to the above-mentioned configuration in which the suppressing coil 7 includes a plurality of turns of wires. For example, as shown in FIG. 7, a suppressing ring 14 formed of a thin sheet metal formed into a loop, which has substantially the same cross sectional area as that of the suppressing coil 7 using wires, is wound around the arch core 5*b* in the same manner as the above-mentioned suppressing coil 7. This also allows the same effect to be attained. In this configuration, it is not necessary to wind wires with a plurality of turns, and thus a manufacturing process can be simplified.

Furthermore, in this embodiment, the arch cores 5*b*3 to 5*b*6 in the center are arranged at a smaller distance from each other. However, the arch cores 5*b* may be arranged at a uniform distance from each other over the entire width. In this case, an amount of heat removed from both the ends through the bearings by heat transfer is made substantially equal to an amount of heat generated that is suppressed by the suppressing coil 7 provided in the center, and thus a temperature distribution can be made uniform over the entire width.

Furthermore, it is not required that an area in which the suppressing coil 7 is placed correspond to a width of a small-width paper sheet to be passed. The area can be set so as to be larger than a width of a small-width paper sheet and smaller than a width of a maximum-width paper sheet in consideration of an amount of heat removed from both the ends through the bearings by heat transfer.

Furthermore, in this embodiment, the suppressing coil 7 was placed only on one side of the arch cores 5*b* so that only one of a pair of magnetic fluxes M that are generated in the arch cores 5*b* was suppressed. However, the suppressing coil 7 also may be placed on each side of the arch cores 5*b*.

(Embodiment 2)

Figure 9:
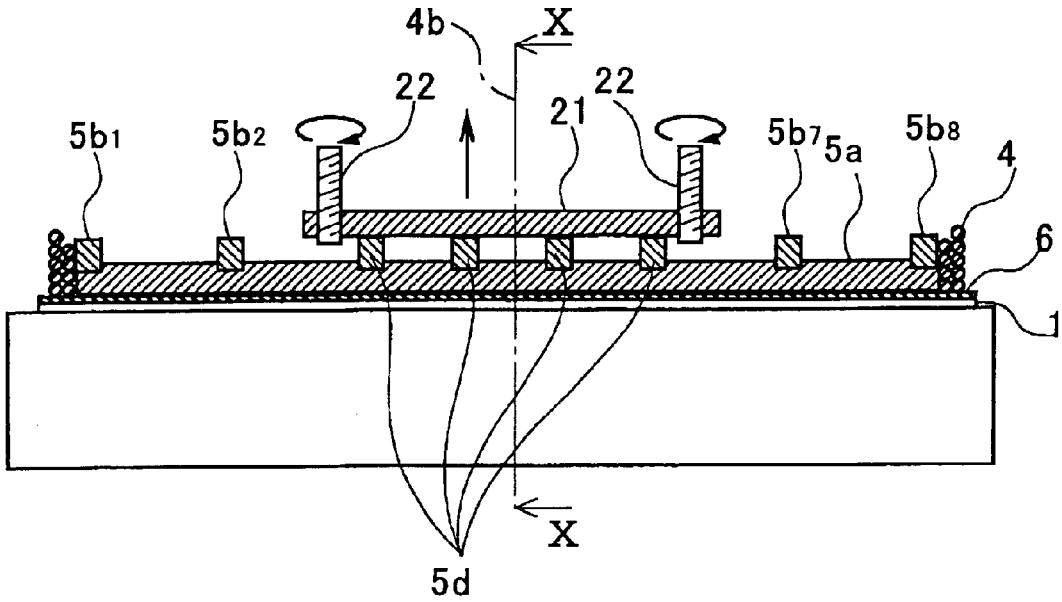
FIG. 9 is a cross sectional view of a heat generating part of an image heating device according to Embodiment 2 of the present invention.
Figure 10:
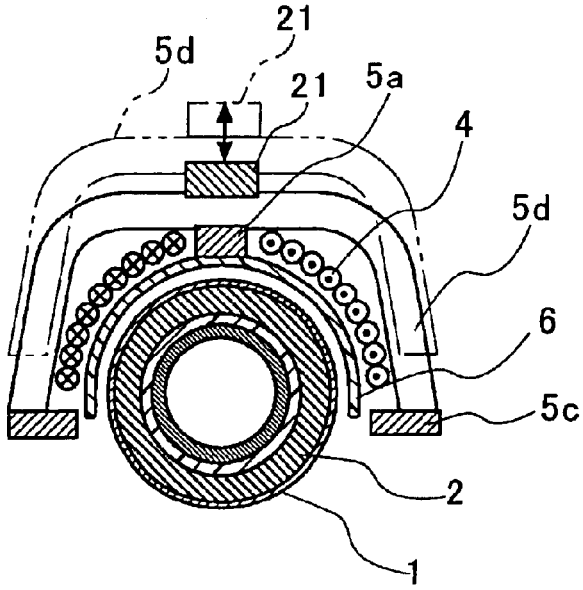
FIG. 10 is a cross sectional view in perspective taken on line X—X of FIG. 9.

FIG. 9 is a cross sectional view of a heat generating part of an image heating device according to Embodiment 2 of the present invention. FIG. 10 is a cross sectional view in perspective taken on line X—X of FIG. 9.

Embodiment 2 is different from Embodiment 1 in the configuration of a heat generation suppressing unit. That is, in this embodiment, a suppressing coil 7 is not provided, and four movable arch cores 5*d* are used in place of the four arch cores 5*b*3 to 5*b*6 in the center portion and are made movable by a moving mechanism composed of a holder 21 and feed screws 22. Except for this, the configuration of this embodiment is the same as that of Embodiment 1. In the following description, like reference characters indicate like constituent members that have the same functions as those described with regard to Embodiment I, for which duplicate descriptions are omitted.

The four movable arch cores 5*d* are of the same dimensions, formed of the same material and arranged at the same distance from each other as in the case of the arch cores 5*b*3 to 5*b*6 of Embodiment 1. These arch cores 5*d* have their upper faces fixed to the holder 21 so as to be held by the holder 21. Each of the feed screws 22 is threaded in an internal thread formed at each end of the holder 21, and an upper end of the feed screw 22 is connected to a rotary mechanism that is not shown in the figure. The feed screws 22 are rotated so that the holder 21 and the movable arch cores 5*d* as a unit move up and down in a radial direction of the heat generating tube 1. In this case, a central core 5*a*, end cores 5*c* and arch cores 5*b*1, 5*b*2, 5*b*7 and 5*b*8 are stationary.

The description is directed to a function of the movable arch cores 5*d* with reference to FIG. 10. When the movable arch cores 5*d* are in a position indicated by a solid line in FIG. 10 (standard position), substantially no space is provided between the movable arch cores 5*d* and each of the central core 5*a* and the end cores 5*c*. In this case, due to a low magnetic reluctance between the movable arch cores 5*d* and each of the central core 5*a* and the end cores 5*c*, in the same manner as the magnetic flux M described with reference to FIG. 4, magnetic flux is likely to be concentrated at the movable arch cores 5*d*. As in Embodiment 1, the four movable arch cores 5*d* arranged in a center portion are spaced at a distance from each other that is smaller than a distance between the respective arch cores 5*b*1 to 5*b*3 and the respective arch cores 5*b*6 to 5*b*8 that are arranged at both ends. Therefore, a larger amount of heat is generated in the center portion that corresponds to the respective positions in which the movable arch cores 5*d* are arranged. Meanwhile, when the arch cores 5*d* are in a position indicated by a chain double-dashed line in FIG. 10 (distant position), a relatively large gap is formed between the movable arch cores 5*d* and each of the central core 5*a* and the end cores 5*c*. In this case, due to a high magnetic reluctance between the movable arch cores 5*d* and each of the central core 5*a* and the end cores 5*c*, magnetic flux is not concentrated at the movable arch cores 5*d*. Thus, an amount of heat generated in the center portion that correspond to the respective positions in which the movable arch cores 5*d* are arranged is decreased relatively.

The description is directed next to an operation performed in the case where recording paper sheets of varying widths are passed continuously.

In this embodiment, the movable arch cores 5*d* that are arranged in positions that correspond to a passing area of a small-width paper sheet in the center are spaced at a distance from each other that is smaller than a distance between the respective arch cores 5*b*1 to 5*b*3 and the respective arch cores 5*b*6 and 5*b*8 that are arranged at both the ends. Therefore, when the movable arch cores 5*d* are in the standard position, a larger amount of heat is generated in the center portion than in both end portions.

Therefore, when passing a maximum-width recording paper sheet, the four movable arch cores 5*d* in the center portion are moved to the distant position. When heating is performed in this state, magnetic flux that passes through the movable arch cores 5*d* is decreased, so that an amount of heat generated in the center portion is suppressed. Thus, a distribution of an amount of heat generated can be made uniform over the entire width of the heat generation tube 1, thereby allowing the whole heat generating tube 1 to be kept at substantially a uniform temperature.

Next, when passing a small-width recording paper sheet, the movable arch cores 5*d* are moved to the reference position. When an electric current is supplied to an excitation coil 4 in this state, in the center portion, since the movable arch cores 5*d* are spaced at a smaller distance from each other, magnetic flux is concentrated, and thus a larger amount of heat is generated. However, the recording paper sheet is passed in this center portion and thus removes heat therefrom. On the other hand, in portions corresponding respectively to the arch cores 5*d*1 to 5*d*3 and the arch cores 5*b*6 to 5*b*8 on both outer sides of the movable arch cores 5*d*, although no paper sheet is passed, since the arch cores 5*b* are spaced originally at a larger distance from each other, an amount of magnetic flux is small, and thus an amount of heat generated is small. Therefore, a temperature rise of the heat generating tube 1 in non-paper passing regions at both the ends can be suppressed. As a result of this, both the end portions where heat is not removed by a recoding paper sheet can be kept at substantially the same temperature as a temperature in the center portion. Further, even when a maximum-width recording paper sheet is passed immediately afterwards, heating can be performed uniformly in a width direction, thereby allowing an excellent image to be formed.

When the movable arch cores 5*d* are in the standard position, in the heat generating tube 1, a larger amount of heat is generated in the center portion than in both the end portions. Therefore, in a state where no paper sheet is passed, the temperature is highest in the center portion. However, the temperature sensor 10 for temperature control is placed at the center portion, and thus an excessive temperature rise in the center portion is prevented.

In this embodiment, it is not necessary to use a relay 8 as an electrical member for passing/interrupting an electric current to the suppressing coil 7 that is used in Embodiment 1. Further, an electromagnetic wave is not generated by an induced potential and an induced current that are generated in the suppressing coil 7 due to an induction electromotive force, and an abrupt change in electric current and voltage, discharge and the like that are caused in the suppressing coil 7 due to switching of the relay 8 also are not caused.

(Embodiment 3)

Figure 11:
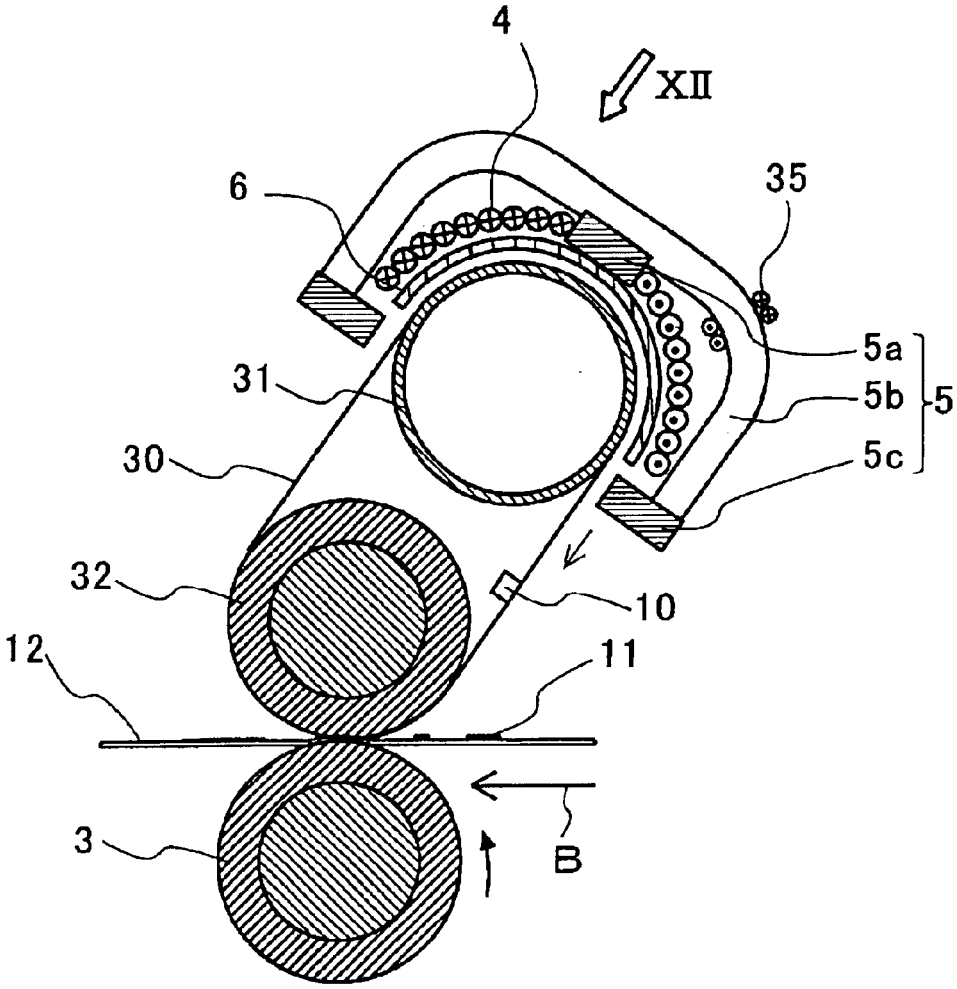
FIG. 11 is a side view in cross section of an image heating device according to Embodiment 3 of the present invention.
Figure 12:
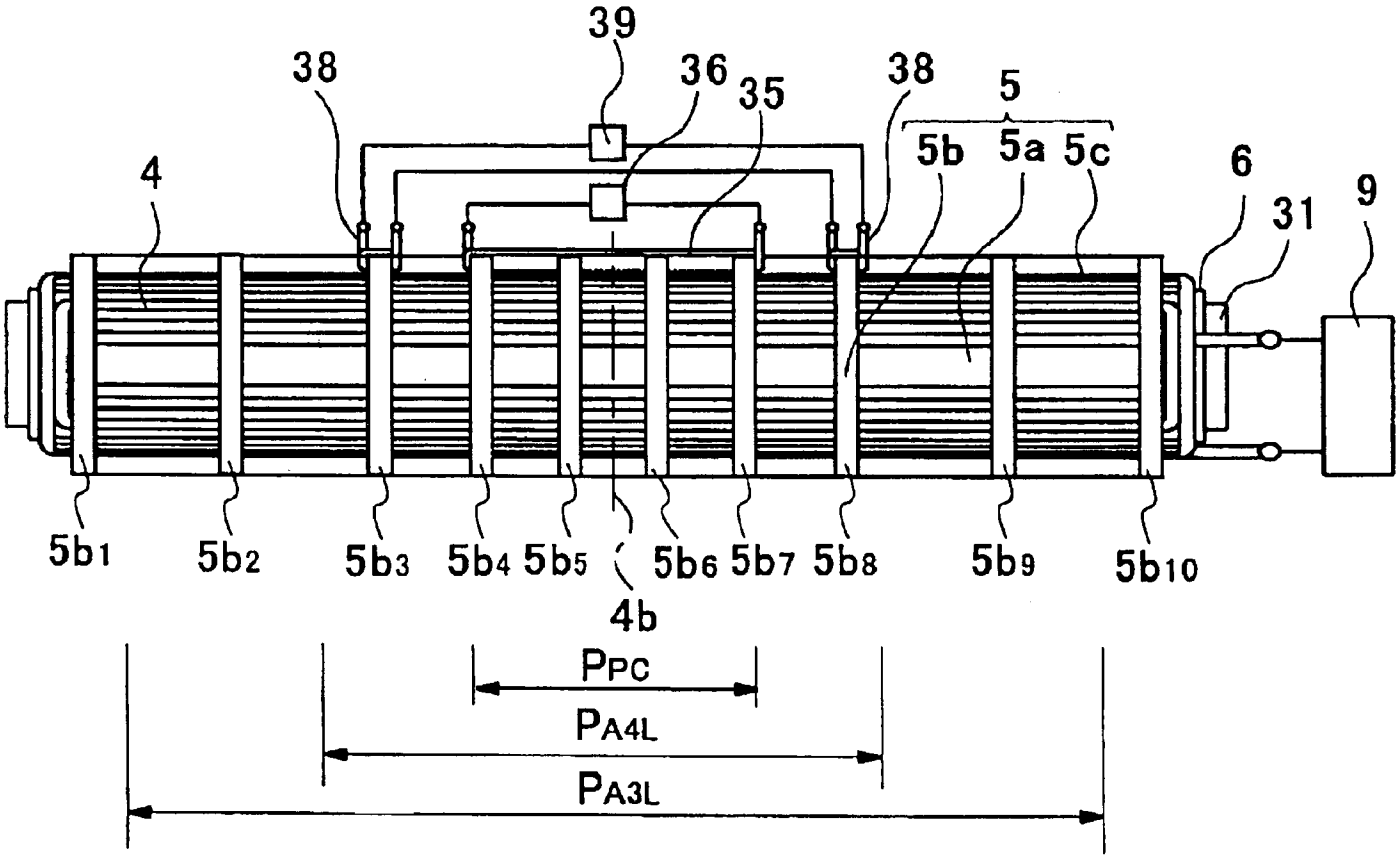
FIG. 12 is a rear view of a heat generating part as seen from a direction indicated by an arrow XII of FIG. 11.
Figure 13:
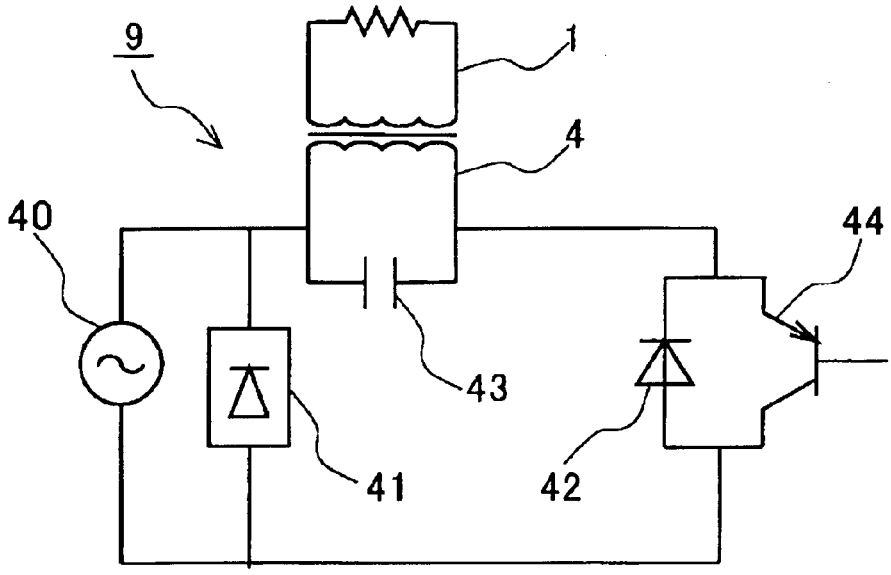
FIG. 13 is a circuit diagram showing a basic configuration of an excitation circuit of the image heating device according to Embodiment 3 of the present invention.
Figure 14:
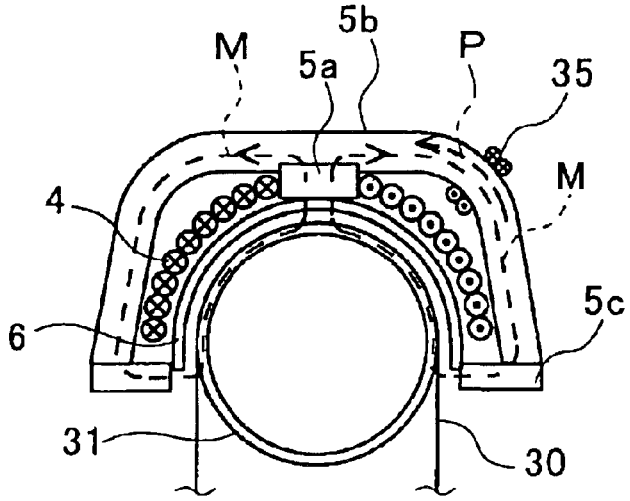
FIG. 14 is a diagram for explaining a heat generating function of the image heating device according to Embodiment 3 of the present invention.

FIG. 11 is a side view in cross section of an image heating device according to Embodiment 3 of the present invention, and FIG. 12 is a rear view of a heat generating part as seen from a direction indicated by an arrow XII of FIG. 11. FIG. 13 is a circuit diagram showing a basic configuration of an excitation circuit 9 of the image heating device according to this embodiment, and FIG. 14 is a diagram for explaining a heat generating function of the image heating device according to this embodiment. In the following description, like reference characters indicate like constituent members that have the same functions as those described with regard to Embodiment 1, for which duplicate descriptions are omitted.

Reference numeral 30 denotes a thin endless fixing belt. The fixing belt 30 is formed from a polyimide resin in which conductive powder is dispersed so that conductivity is imparted. The fixing belt 30 is formed of a 100-$\mu$m thick base material of a diameter of 45 mm with its surface coated with a 150-$\mu$m thick silicone rubber layer and a 20-$\mu$m thick fluorocarbon resin layer as a mold releasing layer that is provided on the silicone rubber layer. However, the configuration of the fixing belt 30 is not limited thereto. For example, as a material of the base material, a heat-resistant material of a fluorocarbon resin, PPS or the like in which powder of a conductive material is dispersed, and an extremely thin metal of nickel, stainless steel or the like that is formed by electroforming also can be used. Further, the mold releasing layer on the surface may be formed by coating of a single material or a combination of materials selected from resin or rubber materials having excellent mold releasability such as PTFE, PFA, FEP, fluorocarbon rubber or the like.

Reference numeral 31 denotes a heat generating roller formed of a magnetic material of carbon steel having a diameter of 20 mm and a thickness of 0.3 mm. Although not shown in the figures, a flange having a central shaft is fitted into each end of the heat generating roller 31 so that the heat generating roller 31 is supported rotatably. Further, although not shown in the figures, a rib for preventing the fixing belt 30 from meandering is provided on each end of the heat generating roller 31.

Reference numeral 32 denotes a fixing roller of a diameter of 30 mm that has low thermal conductivity. The fixing roller 32 is formed of an elastic foam body of silicone rubber whose surface has a low hardness (Asker-C45 degrees).

The fixing belt 30 is suspended with a predetermined tensile force between the heat generating roller 31 and the fixing roller 32 and is allowed to travel in a direction indicated by an arrow.

A pressure roller 3 as a pressure unit has an outer diameter of 30 mm. As shown in the figure, the pressure roller 3 is in contact under pressure with the fixing roller 32 through the fixing belt 30, so that a nip part is formed between the pressure roller 3 and the fixing belt 30. In this embodiment, the pressure roller 3 is driven, and the fixing roller 32, the fixing belt 30 and the heat generating roller 31 are rotated following the rotation of the pressure roller 3.

In the image heating device according to this embodiment, the maximum width of recording paper sheets to be passed is defined as a length of a short side of a JIS size A3 paper sheet (length of 297 mm). Based on this, the fixing belt 30 has a width of 350 mm, the heat generating roller 31 has a length of 360 mm, a width between outermost ends of a core 5 is 322 mm, a width between outermost ends of an excitation coil 4 is 342 mm, and a coil holding member 6 has a width of 355 mm.

In the same manner as in Embodiment 1, the core 5 is composed of a plurality of arch cores 5*b* arranged at a distance from each other in a width direction, a central core 5*a* that is coupled magnetically with these arch cores 5*b*, and end cores 5*c*. However, in this embodiment, the number of the arch cores 5*b* is 10, which is different from that in Embodiment 1. As shown in FIG. 12, letting the arch cores 5*b* be denoted as 5*b*1, 5*b*2, . . . , 5*b*10 in the order starting from the left, the arch cores 5*b*1 to 5*b*3 and the arch cores 5*b*8 to 5*b*10 at both ends are spaced at a distance of 20 mm from each other, and the arch cores 5*b*3 to 5*b*8 in a center portion are spaced at a distance of 10 mm from each other. All of the arch cores 5*b* are equal in dimensions and have a width (dimension in a rotation axis direction of the heat generation roller 31) of 5 mm. Other dimensions and the material used are the same as those in Embodiment 1.

The excitation coil 4 and the coil holding member 6 are in the same forms and made of the same materials as those used in Embodiment 1 except for dimensions in the width direction.

Reference numeral 35 denotes a first suppressing coil as a heat generation suppressing unit. The first suppressing coil 35 is formed of a wire bundle composed of 20 wires of a copper wire with its surface insulated that has an outer diameter of 0.15 mm. As shown in FIG. 12, the first suppressing coil 35 is wound with two turns around the four arch cores 5*b*4 to 5*b*7 in a center so as to bridge between the arch core 5*b*4 and the arch core 5*b*7. Further, as shown in FIG. 11, the first suppressing coil 35 is wound only on one side of the arch cores 5*b* with respect to the central core 5*a*.

Reference numeral 36 denotes a switching element as a switching unit. The switching element 36 is connected across the first suppressing coil 35 and performs switching of electrical connection between on/off states.

Reference numeral 38 denotes a second suppressing coil that is wound with two turns respectively around the arch cores 5*b*3 and 5*b*8 between which the arch cores 5*b*4 to 5*b*7 with the first suppressing coil 35 are interposed.

Reference numeral 39 denotes a second switching element as a switching unit. The second switching element 39 is connected across the second suppressing coil 38 and performs switching of electrical connection between on/off states.

A temperature sensor 10 is provided at a center portion of the fixing belt 30 in a width direction (rotation axis direction of the heat generating roller 31). Based on a temperature signal from this temperature sensor 10, a high-frequency alternating current to be applied to the excitation coil 4 by an inverter is controlled so that the temperature of a surface of the fixing belt 30 is 170 degrees centigrade, which is a set fixing temperature.

FIG. 13 shows a basic circuit of a single-ended voltage-fed resonant inverter that is used in the excitation circuit 9. An alternating current from a commercial power source 40 is rectified in a rectifier circuit 41 and applied to the inverter. In the inverter, a high-frequency current is applied to the excitation coil 4 using a switching element 44 such as an IGBT (Insulated Gate Bipolar Transistor) and a resonant capacitor 43. Reference numeral 42 denotes a diode. In this embodiment, an alternating current having a maximum voltage amplitude of 650 V and a maximum current amplitude of 65 A is applied from the excitation circuit 9.

In the image heating device having the above-mentioned configuration, as shown in FIG. 11, a recording paper sheet 12 carrying a toner image 11 on its surface is allowed to enter the nip part from a direction indicated by an arrow B so that fixing of a toner 11 on the recording paper sheet 12 is performed.

The description is directed next to a function in which the excitation coil 4 causes the heat generating roller 31 to generate heat by electromagnetic induction with reference to FIG. 14.

As indicated by a broken line in FIG. 14, magnetic flux M generated in the excitation coil 4 due to an alternating current from the excitation circuit 9 penetrates the fixing belt 30 from the end core 5*c*, enters the heat generating roller 31, and passes through the heat generating roller 31 in a circumferential direction due to magnetism of the heat generating roller 31. Then, the magnetic flux M penetrates the fixing belt 30 again, enters the central core 5*a*, and passes through the arch core 5*b* so as to reach the end core 5*c*. In each of the arch cores 5*b*, a pair of such magnetic fluxes M in the form of a loop are formed so as to be substantially symmetrical with respect to the central core 5*a*. Then, this pair of magnetic fluxes M are generated and disappear repeatedly due to an alternating current of the excitation circuit 9. By a change in the magnetic flux M, an eddy current is induced in each of the heat generating roller 31 and the fixing belt 30, so that Joule heat is generated.

In the following description, a function of the first and second suppressing coils 35 and 38 as the heat generation suppressing units in this embodiment will be explained.

The description is directed to the case where a maximum-width recording paper sheet is passed, namely, the case where a JIS size A3 paper sheet is passed in a longitudinal direction. A passing area of the recording paper sheet in this case corresponds to an area denoted as PA3L shown in FIG. 12. In this case, each of the switching elements 36 and 39 is set to be in a connected state. When an electric current is supplied to the excitation coil 4 in this state, in each of the suppressing coils 35 and 38, an induction electromotive force is generated by the excitation coil 4, so that an induced current is caused to flow. Due to an electric current in each of the suppressing coils 35 and 38, magnetic flux P in a direction in which a change in the magnetic flux M generated by the excitation coil 4 is cancelled out is generated (see FIG. 14). Therefore, the concentration of magnetic flux that is caused due to a small distance between the respective arch cores 5*b*3 to 5*b*8 in the center portion is reduced, and thus the heat generating roller 31 and the fixing belt 30 are heated uniformly over substantially the entire width. The recording paper sheet 12 being passed removes heat from substantially the entire width, and thus the fixing belt 30 can be kept at a uniform temperature over the entire width by magnetic flux generated by the excitation coil 4.

Next, in the case where a recording paper sheet of the minimum width (width of 105 mm) such as a post card is passed, a passing area of the recording paper sheet corresponds to an area denoted as $P_{PC}$ shown in FIG. 12. The passing area $P_{PC}$ of a minimum-width recording paper sheet has a size substantially equal to a distance between the arch core 5*b*4 and the arch core 5*b*7 on which the first suppressing coil 35 is provided. In this case, the switching element 36 for the first suppressing coil 35 is opened, and the switching element 39 for the second suppressing coil 38 provided on both sides of the first suppressing coil 35 is switched to the connected state. In this state, the first suppressing coil 35 in the center portion does not come into operation, and the second suppressing coil 38 on both sides of the first suppressing coil 35 comes into operation.

The first suppressing coil 35 does not come into operation, and thus a larger amount of heat is generated in a region corresponding to the arch cores 5*b*4 to 5*b*7 that are arranged at a smaller distance from each other. However, the recording paper sheet is passed in this region and thus removes heat therefrom.

Although no recording paper sheet is passed in regions corresponding respectively to the arch cores 5*b*3 and 5*b*8 on both outer sides of the passing area $P_{PC}$ of a minimum-width recording paper sheet, since the second suppressing coil 38 comes into operation, an increase in amount of heat generated that is caused due to the small distances between the arch core 5*b*3 and the arch core 5*b*4 that is on a center side of and adjacent to the arch core 5*b*3 and between the arch core 5*b*8 and the arch core 5*b*7 that is on the center side of and adjacent to the arch core 5*b*8 is suppressed.

In regions on both outer sides of the arch core 5*b*3 and the arch core 5*b*8, namely, in regions corresponding respectively to the arch cores 5*b* 1 to 5*b*3 and the arch cores 5*b*8 to 5*b*10, no recording paper sheet is passed, either. However, in these regions, since the arch cores 5*b*1 to 5*b*3 and the arch cores 5*b*8 to 5*b*10 are arranged at a larger distance from each other, an amount of magnetic flux is small, and thus an amount of heat generated is small. Moreover, in both end portions, heat is removed by heat transfer through bearings of the heat generating roller 31.

As described above, in non-paper passing regions on both the outer sides of the passing area $P_{PC}$ of a recording paper sheet, a temperature rise in each of the heat generating roller 31 and the fixing belt 30 can be suppressed. As a result of this, both the end portions from which heat is not removed even by minimum-width recording paper sheets being passed continuously can be kept at substantially the same temperature as a temperature in the center portion. Further, even in the case where a maximum-width recording paper sheet is passed immediately afterward, heating can be performed uniformly in the width direction, thereby allowing an excellent image to be formed.

The description is directed next to the case where a JIS size A4 paper sheet is passed in a longitudinal direction. In this case, a passing area of a recording paper sheet corresponds to an area denoted as $P_{A4L}$ shown in FIG. 12. The passing area $P_{A4L}$ of an A4-sized paper sheet has a size substantially equal to a distance between the arch core 5*b*3 and the arch core 5*b*8 on which the second suppressing coil 38 is provided. In this case, both of the first and second switching elements 36 and 39 that are connected respectively to the first suppressing coil 35 in the center and the second suppressing coil 38 on both the outer sides of the first suppressing coil 35 are brought to an open state. When an electric current is supplied to the excitation coil 4 in this state, an induction electromotive force is generated in each of the suppressing coils 35 and 38 by the excitation coil 4. However, since the open state is established across each of the suppressing coils 35 and 38, an induced current is not caused to flow, and thus the magnetic flux P in a direction in which a change in the magnetic flux M is cancelled out is not generated. Since the first and second suppressing coils 35 and 38 do not come into operation, in a region corresponding to the arch cores 5*b*3 to 5*b*8 that are arranged at a smaller distance from each other, magnetic flux is concentrated, and thus a larger amount of heat is generated than on both outer sides of the arch cores 5*b*3 to 5*b*8. However, the recording paper sheet is passed in this region and thus removes heat selectively therefrom. On the other hand, on both the outer sides of the passing area $P_{A4L}$ of a recording paper sheet, although no paper sheet is passed, since the arch cores 5*b* are spaced originally at a larger distance from each other, an amount of magnetic flux is small, and thus an amount of heat generated is small. Moreover, in both the end portions, heat is removed by heat transfer through the bearings of the heat generating roller 31. Thus, a temperature rise in each of the heat generating roller 31 and the fixing belt 30 in non-paper passing regions on both the outer sides of the passing area $P_{A4L}$ of a recording paper sheet can be suppressed. As a result of this, both the end portions from which heat is not removed even by A4-sized recoding paper sheets being passed continuously can be kept at substantially the same temperature as a temperature in the center portion. Further, even in the case where a maximum-width recording paper sheet is passed immediately afterwards, heating can be performed uniformly in the width direction, thereby allowing an excellent image to be formed.

As described above, according to this embodiment, members such as bearings of the fixing belt 30 and the heat generating roller 31 or the like can be prevented from being heated to a temperature above a temperature that the members can withstand due to an excessive temperature rise at both the end portions from which heat is not removed by a recording paper sheet, resulting in breakage or deterioration of the members. Moreover, even when a maximum-width recording paper sheet is passed right after small-width paper sheets are passed continuously, a uniform temperature distribution is maintained in a passing area of a maximum-width recording paper sheet of the fixing belt 30, thereby allowing the occurrence of hot offset to be prevented.

Furthermore, in this embodiment, as in Embodiment 1, when passing a small-width paper sheet, the first switching element 36 (and the second switching element 39) is/are brought to the open state, and thus a total amount of magnetic flux generated by the excitation coil 4 is increased. Therefore, the inductance of the excitation coil 4 increases, thereby increasing the load impedance of the excitation coil 4. As a result, an amount of a driving current that passes through the excitation coil 4 is decreased, thereby decreasing an amount of heat generated. Thus, it is possible to eliminate the need for, or to simplify the configuration of an electric current controlling circuit for controlling a driving current used when a small-width paper sheet is passed and thus it is necessary to reduce an amount of heat generated.

Furthermore, in this embodiment, the first and second suppressing coils 35 and 38 are provided only on one side of the six arch cores 5*b*3 to 5*b*8 in the center with respect to the central core 5*a*. Therefore, by bringing the switching elements 36 and 39 to the connected state, only one of the pair of magnetic fluxes M that are generated in the arch cores 5*b*3 to 5*b*8 is suppressed by the first and second suppressing coils 35 and 38 (see FIG. 14). That is, no influence is exerted on the other magnetic flux M generated in the arch cores 5*b*3 to 5*b*8. Moreover, the arch cores 5*b*3 to 5*b*8 on which the first and second suppressing coils 35 and 38 are provided are set to be arranged at a distance from each other that is half the distance between the respective arch cores 5*b*1 to 5*b*3 and the respective arch cores 5*b*8 to 5*b*10 in both the end portions. Thus, even if the switching elements 36 and 39 are brought to the connected state and thus the above-mentioned one of the magnetic fluxes M is hindered from passing through the arch cores 5*b*3 to 5*b*8, that does not cause the magnetic flux to be diffused into a wide area on a side opposite to a side of the heat generating roller 31 with respect to the arch cores 5*b*3 to 5*b*8. As a result of this, unintended heating of a peripheral member can be prevented.

Furthermore, in this embodiment, the switching elements 36 and 39 are switched over after passing of a recording paper sheet is started. That is, when the supply of an electric current is started right after a power source is turned on, during standby in which a constant temperature is maintained, or when a large-width paper sheet is passed, the switching elements 36 and 39 are brought to the connected state so that the fixing belt 30 is heated uniformly over the entire width. Then, after passing of a paper sheet is started, the switching elements 36 and 39 are switched over so as to correspond to a width of a recording paper sheet, and thus a temperature rise at the end portions is suppressed, thereby allowing a uniform temperature to be attained over the entire width even during passing of the paper sheet. Thus, even when a wide-width paper sheet is passed during continuous passing of small-width paper sheets, an appropriate temperature always can be obtained over the entire width without causing an increase in time interval between paper-passing operations. As a result of this, hot offset attributable to an excessive temperature rise at the end portions and cold offset attributable to an excessive temperature drop at the end portions can be prevented.

Moreover, in the conventional image heating devices, in the case where the temperature is raised excessively in both end portions when small-width paper sheets are passed continuously, it has been required to take the following actions. That is, a printing operation is stopped and the device is left on standby until the temperature at both ends is lowered, and a time interval at which recording paper sheets are passed is increased. On the other hand, in this embodiment, when small-width paper sheets are passed continuously, a temperature rise in both the ends can be suppressed. Therefore, when the temperature is raised excessively, it is not necessary to carry out a standby and increase a time interval between the paper-passing operations. Thus, when outputting small-width paper sheets continuously, a throughput that is the number of the paper sheets output per a unit time can be set so as to have a high value.

When the switching elements 36 and 39 are switched over during the application of a high-frequency current to the excitation coil 4, unwanted electromagnetic wave noise may be generated, or the operations of the switching elements 36 and 39 may be impaired. This is caused by a switching operation performed in a state where an electric current and a voltage of each of the suppressing coils 35 and 38 are large, which are induced by a change in the magnetic flux M due to a high-frequency current applied to the excitation coil 4.

Specifically, in the case where the switching elements 36 and 39 are switched off when an electric current induced in each of the suppressing coils 35 and 38 is large, an abrupt change in which a value of the electric current of each of the suppressing coils 35 and 38 becomes 0 is caused. Therefore, due to the inductance of each of the suppressing coils 35 and 38, an excessively high voltage is generated in each of the switching elements 36 and 39, thereby causing sparking and insulation destruction.

Furthermore, when an electric current to each of the suppressing coils 35 and 38 is interrupted, a change in the magnetic flux M due to a high-frequency current applied to the excitation coil 4 induces a voltage across each of the suppressing coils 35 and 38. If the switching elements 36 and 39 are switched on when this induced voltage is high, at a moment of the switching on, a large electric current passes through each of the switching elements 36 and 39, raising a possibility that a breakdown is caused therein.

In order to solve the above-mentioned problems, in this embodiment, when the switching elements 36 and 39 are switched over, the application of a high-frequency current to the excitation coil 4 is brought to a stop. Thus, the generation of an excessively high voltage in the switching elements 36 and 39 that passes/interrupts an electric current to the suppressing coils 35 and 38 and the occurrence of sparking and insulation destruction can be prevented. At the same time, an abrupt change in electric current and voltage that is caused in the suppressing coils 35 and 38 due to switching of the switching elements 36 and 39 is prevented, and thus the generation of unwanted electromagnetic wave noise also can be prevented.

In this embodiment, the suppressing coils 35 and 38 are formed of a wire bundle of 10 wires and thus have a low electric resistance with respect to a high-frequency alternating current. Thus, a large induced current can be obtained, thereby allowing a function of suppressing magnetic flux to be enhanced.

Furthermore, in this embodiment, the suppressing coils 35 and 38 are wound with two turns on the arch cores 5*b*. The second turns of the suppressing coils 35 and 38 are drawn out so as to be connected to the switching elements 36 and 39, respectively, and therefore, the number of the turns that is effective to form a magnetic circuit is 1 to 1.5. By increasing the number of the turns, a function of suppressing the magnetic flux M generated by the excitation coil 4 can be enhanced further. Thus, by changing the number of turns depending on the degree of temperature ununiformity in the width direction, temperature uniformity of the heat generating roller 31 in the rotation axis direction can be regulated.

Moreover, in this embodiment, the suppressing coils 35 and 38 were formed of a wire bundle of 10 wires having an outer diameter of 0.2 mm. However, by adjusting the number of the wires constituting the wire bundle, the function of suppressing the magnetic flux M performed by the suppressing coils 35 and 38 also can be adjusted.

In this embodiment, as a material of the suppressing coils 35 and 38, a copper wire was used. Although the material of the suppressing coils 35 and 38 is not limited thereto, it is desirable that the material have a low electric resistance. Specifically, with an electric resistance of 0.2 Ω or lower at a frequency of a high-frequency current applied to the excitation coil 4, heat generation caused by an induced electric current can be prevented. At the same time, since a larger electric current is induced, a sufficient effect of controlling a heat generation distribution can be attained.

Furthermore, since the heat generating roller 31 is disposed on an inner side of the fixing belt 30, and the excitation coil 4, the core 5, and the suppressing coils 35 and 38 are disposed on an outer side of the fixing belt 30, the following can be achieved. That is, a temperature rise hardly is caused in the excitation coil 4 or the like by heat transfer from a heat generating part including the heat generating roller 31 or the like, thereby allowing a change in the amount of heat generated to be prevented from being caused due to an excessive temperature rise in these members.

The arch cores 5*b* may be placed obliquely with respect to a rotation axis of a heat generating member. In this case, positions of both the ends of each of the arch cores 5*b* in the rotation axis direction of the heat generating roller 31 are different from each other. Therefore, points at which magnetic flux is concentrated are dispersed in the rotation axis direction, and thus variations in heat generation of the heat generating roller 31 in the rotation axis direction can be suppressed.

In this embodiment, each of the wire bundles of the suppressing coils 35 and 38 was wound on the arch cores 5*b* with two turns so that the respective turns of the wire bundle were in close contact with each other. However, the wire bundle also may by wound on the arch cores 5*b* so that a gap is provided between the respective turns of the wire bundle. In this configuration, an area in which the suppressing coil is placed can be increased using a reduced amount of wires. Thus, a heat generation controlling effect provided by the suppressing coil can be enhanced.

(Embodiment 4)

Figure 15:
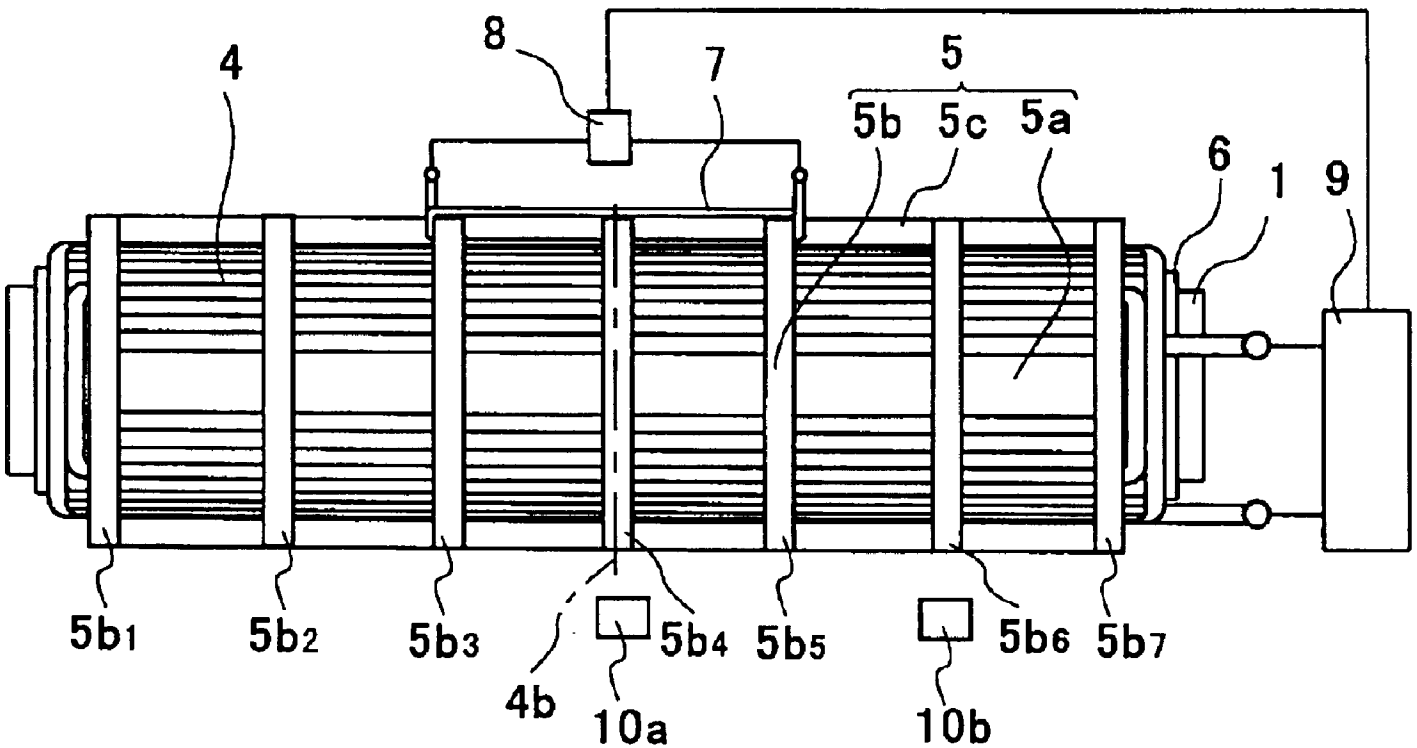
FIG. 15 is a rear view of a heat generating part of an image heating device according to Embodiment 4 of the present invention.

FIG. 15 is a rear view of a heat generating part of an image heating device according to Embodiment 4 of the present invention. In the following description, like reference characters indicate like constituent members that perform the same functions as those described with regard to Embodiment I, for which duplicate descriptions are omitted.

This embodiment is different from Embodiment 1 as described below. That is, a plurality of arch cores 5*b* are arranged at substantially a uniform distance from each other in a width direction. Further, as a material of the three arch cores 5*b* in a center portion, around which a suppressing coil 7 is wound, a material having a magnetic permeability higher than that of the arch cores 5*b* on both outer sides of the three arch cores 5*b*. Moreover, two temperature sensors 10 are provided. One of the two temperature sensors 10, i.e., a temperature sensor 10*a* is provided within a passing area of a minimum-width recording paper sheet, and the other, i.e. a temperature sensor 10*b* is provided outside the passing area of a minimum-width recording paper sheet. Each of the temperature sensors 10 detects the temperature of the heat generating tube 1. Based on temperature signals of both the temperature sensors 10*a* and 10*b* that are obtained during passing of a recording paper sheet, a switching element 8 is switched over so as to regulate magnetic flux, thereby regulating an amount of heat generated. In addition, a synchronizing unit is provided that synchronizes the timing at which the switching element 8 is opened/closed with a variation in a high-frequency current fed to an excitation coil 4 from a voltage resonant inverter of an excitation circuit 9. Except for the above-mentioned points, the configuration of this embodiment is the same as that of Embodiment 1.

As shown in FIG. 15, letting the seven arch cores 5*b* be denoted as 5*b*1, 5*b*2, . . . , 5*b*7 in the order starting from the left, the suppressing coil 7 is wound around the arch cores 5*b* in a center so as to bridge between the arch core 5*b*3 and the arch core 5*b*5. A material of the arch cores 5*b*3 to 5*b*5 has a magnetic permeability higher than that of a material of the arch cores 5*b* 1, 5*b*2, 5*b*6 and 5*b*7 on both the outer sides of the arch cores 5*b*3 to 5*b*5. Therefore, when the switching element 8 is in an open state, magnetic flux is concentrated at the arch cores 5*b*3 to 5*b*5, and thus a larger amount of heat is generated in a region corresponding to these cores. On the other hand, when the switching element 8 is switched on, the concentration of magnetic flux is reduced by a function of the suppressing coil 7, and thus a distribution of an amount of heat generated in the width direction is made substantially uniform. The suppressing coil 7 has the same functions with respect to the distribution of an amount of heat generated and a temperature distribution as those in Embodiment 1.

In this embodiment, the temperature of the heat generating tube 1 is detected by the temperature sensors 10*a* and 10*b* that are provided respectively within and outside the passing area of a minimum-width recording paper sheet, and the switching element 8 is switched over based on temperature signals of the temperature sensors 10*a* and 10*b*. More specifically, in passing small-width paper sheets continuously, when a temperature detected by the temperature sensor 10*b* provided outside the passing area of a recording paper sheet becomes higher by 10 degrees than a fixing temperature, the switching element 8 is opened so that the temperature at both ends is lowered. When a temperature detected by the temperature sensor 10*b* provided outside the passing area of a recording paper sheet becomes lower by 10 degrees than the fixing temperature, the switching element 8 is switched on so that an amount of heat generated is made uniform over the entire width, thereby preventing a temperature drop in end portions. Thus, in the end portions of the heat generating tube 1 in a rotation axis direction, an excessive temperature rise and an extreme temperature drop can be prevented with reliability.

Furthermore, in this embodiment, the timing at which the switching element 8 is switched over as described above is synchronized with a variation in a high-frequency current supplied to the excitation coil 4 from the voltage resonant inverter of the excitation circuit 9 for the following reason. That is, when the switching element 8 is switched over in a state where an electric current and a voltage of the suppressing coil 7 are large, which are induced by a change in the magnetic flux M due to a high-frequency current supplied to the excitation coil 4, unwanted electromagnetic wave noise is generated, or the operation of the switching element 8 is impaired, which is disadvantageous.

Specifically, when the switching element 8 is in a connected state, by a change in the magnetic flux M due to a high-frequency current applied to the excitation coil 4, a high-frequency current of substantially the same waveform is generated in the suppressing coil 7. In the case where the switching element 8 is switched off when an electric current induced in the suppressing coil 7 is large, an abrupt change in which a value of the electric current of the suppressing coil 7 becomes 0 is caused. Therefore, an excessively high voltage is generated in the switching element 8 that interrupts an electric current to the suppressing coil 7, thereby causing sparking and insulation destruction.

On the other hand, when the switching element 8 is in the open state, by a change in the magnetic flux M due to a high-frequency current applied to the excitation coil 4, a voltage is induced across the suppressing coil 7. The voltage thus induced has substantially the same waveform as that of a high-frequency voltage applied to the excitation coil 4. In the case where the switching element 8 is switched on when this induced voltage is large, at a moment of the switching on, sparking or insulation destruction is caused or a large electric current flows therethrough.

In order to solve the above-mentioned problems, in this embodiment, the timing at which the switching element 8 is switched over is synchronized with a variation in a high-frequency current supplied to the excitation coil 4 from the voltage resonant inverter of the excitation circuit 9. Therefore, at a moment when an electric current or a voltage of the same waveform as that of a high-frequency current supplied to the excitation coil 4, which is induced in the suppressing coil 7 due to the high-frequency current, has a value of substantially 0, the switching element 8 can be switched over. Thus, the generation of an excessively high voltage in the switching element 8 that passes/interrupts an electric current to the suppressing coil 7 and the occurrence of sparking and insulation destruction can be prevented. At the same time, an abrupt change in electric current and voltage that is caused in the suppressing coil 7 due to switching of the switching element 8 is prevented, and thus the generation of unwanted electromagnetic wave noise also can be prevented.

The same effect also can be attained by the following configuration. That is, a zero cross detecting circuit for an electric current or a voltage is placed in a power source circuit or the excitation circuit 9, and based on a zero cross detection signal for an electric current or a voltage, the switching element 8 is switched over.

Furthermore, the synchronization of switching of the switching element 8 with a variation in a high-frequency current supplied to the excitation coil 4 also can be achieved in the following manner. That is, the switching element 8 is switched over at a timing that is the same as the switching timing of a switching element 8 for the inverter of the excitation circuit 9. In this case, it is not required that the switching element 44 be switched over at a timing that is exactly the same as the switching timing of the switching element 44, and the respective timings may be shifted by a predetermined time.

The number of times of switching of the switching element 8 is not limited to one during one recording operation. A switching operation also can be performed a plural number of times so as to correspond to a change in temperature during the recording operation. Moreover, the switching operation also can be performed ten to several thousand times per second. In the case where the switching operation is performed a large number of times, unwanted electromagnetic wave noise is likely to be generated. Therefore, it is particularly important that the timing at which the switching element 8 is switched over is synchronized with a variation in a high-frequency current supplied to the excitation coil 4. The switching operation of the switching element 8 can be performed, for one recording operation, once to the number of times corresponding to a frequency of the high-frequency current.

In this embodiment, the arch cores **5*b*3 to 5*b*5 in the center portion are set to have a high magnetic permeability, and all of the arch cores 5*b* 1 to 5*b*7 are arranged at a uniform distance from each other. According to this configuration, the number of the arch cores 5*b*** to be placed can be reduced, thereby allowing the device to be of a simple configuration and less costly.

In this embodiment, the arch cores **5*b*3 to 5*b*5 in the center portion were set to have a magnetic permeability higher than that of the arch cores 5*b*1, 5*b*2, 5*b*6 and 5*b*7 on both the outer sides. However, the same effect also can be attained by the following configuration. That is, alternatively, or in addition to this, a cross sectional area of the arch cores 5*b*3 to 5*b*5 in the center portion in a plane orthogonal to the magnetic flux M is increased (that is, the arch cores 5*b*3 to 5*b*5** are increased in thickness).

(Embodiment 5)

Figure 16:
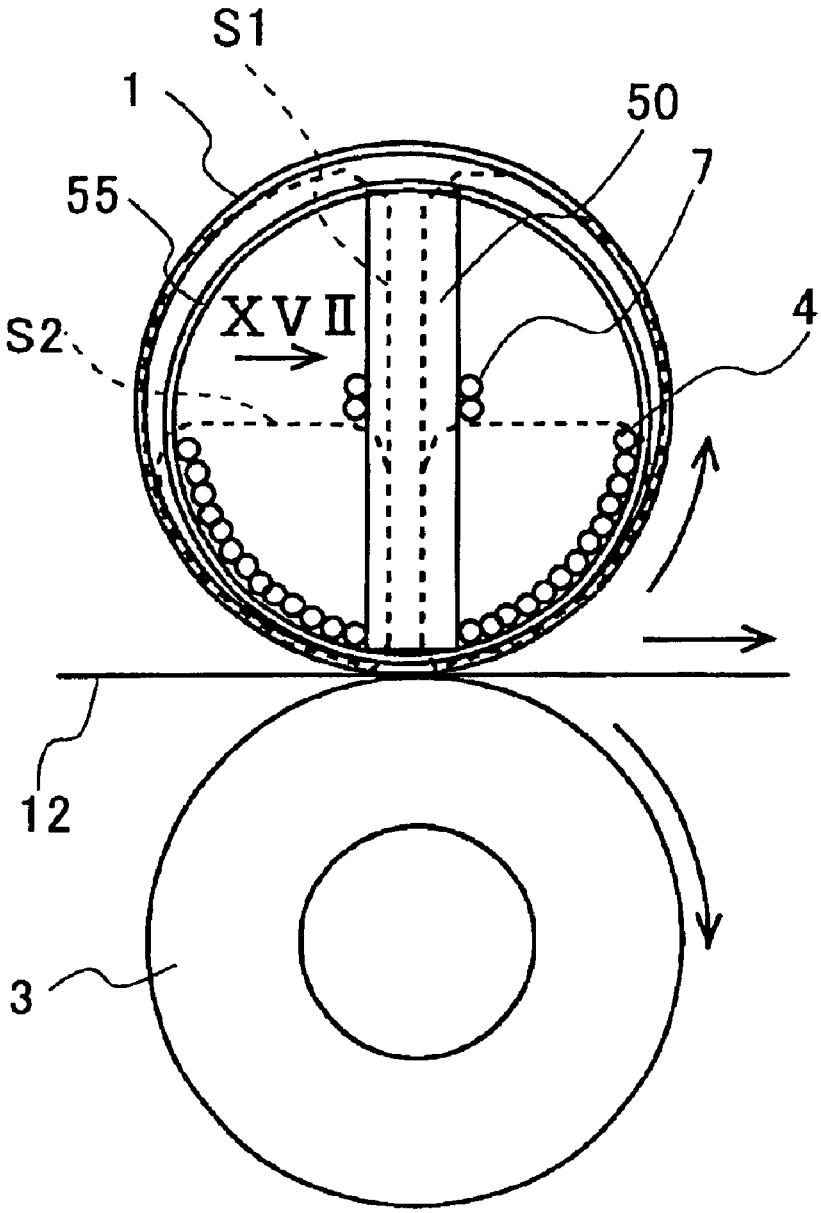
FIG. 16 is a side view in cross section of an image heating device according to Embodiment 5 of the present invention at a center position in a width direction.
Figure 17:
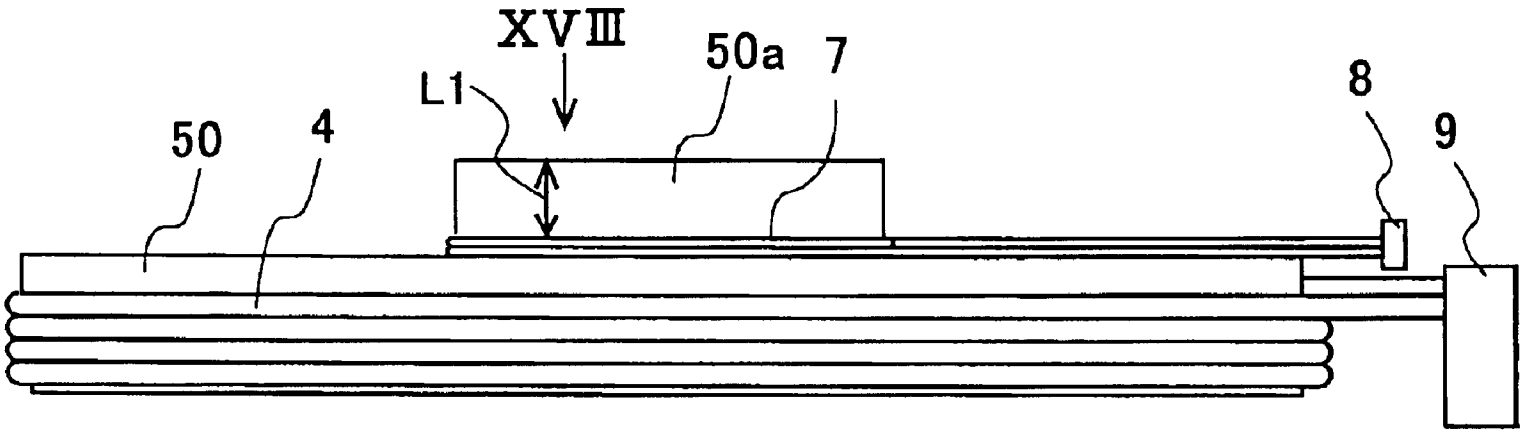
FIG. 17 is a front view of a core as seen from a direction indicated by an arrow XVII of FIG. 16.
Figure 18:
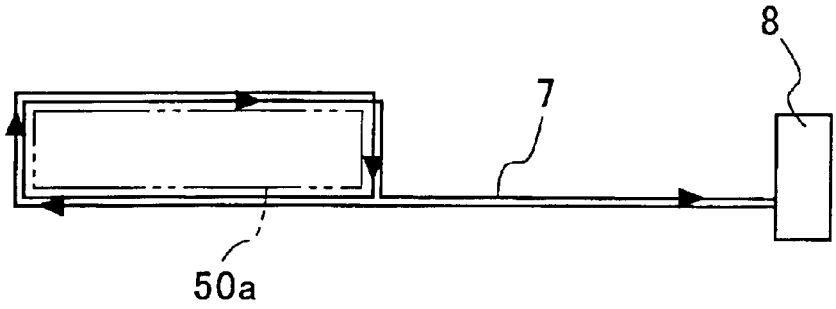
FIG. 18 is a plan view as seen from a direction indicated by an arrow XVIII of FIG. 17 for showing directions of an electric current that passes through a suppressing coil at a particular moment.

FIG. 16 is a side view in cross section of an image heating device according to Embodiment 5 of the present invention at a center position in a width direction. FIG. 17 is a front view of a core 50 as seen from a direction indicated by an arrow XVII of FIG. 16. FIG. 18 is a plan view as seen from a direction indicated by an arrow XVIII of FIG. 17 for showing directions of an electric current that passes through a suppressing coil 7 at a particular moment. In the following description, like reference characters indicate like constituent members that perform the same functions as those described with regard to Embodiment 1, for which duplicate descriptions are omitted.

Unlike in Embodiment 1, in this embodiment, the core 50 that is substantially rectangular in cross section is placed in an inner portion of a cylindrical guide 55, and an excitation coil 4 is wound around the core 50 along an inner face of the guide 55. A heat generating tube 1 formed of a conductive material is provided externally over an outer peripheral face of the guide 55 and supported rotatably. The core 50 has a length substantially equal to the length of the heat generating tube 1. As shown in FIG. 17, the excitation coil 4 is wound over the entire width of the core 50.

As shown in FIG. 17, the front shape of the core 50 is such that a stair-shaped convex portion **50*a* is provided in a center portion in a longitudinal direction that corresponds to a passing area of a minimum-width recording paper sheet, and thus is longer vertically in the center portion than at both ends of the convex portion 50*a*. A suppressing coil 7 as a heat generation suppressing unit is wound around this convex portion 50*a*. A switching element 8 that makes/interrupts electrical connection is connected across the suppressing coil 7. The suppressing coil 7 is wound with substantially two turns around the convex portion 50*a* so that the respective turns are in close contact with each other, and both ends of the suppressing coil 7 are drawn out to one end portion. In FIG. 18, the directions of an electric current that passes through the suppressing coil 7** at a particular moment are indicated by arrows.

In the following description, a function of the suppressing coil 7 will be described with reference to FIG. 16.

The description is directed first to the case where the switching element 8 that passes/interrupts an electric current to the suppressing coil 7 is in a disconnected state. In this case, in a portion in which the convex portion **50*a* is formed, magnetic flux indicated by a dotted line S1 in FIG. 16 penetrates the core 50 in a vertical direction. Then, the magnetic flux penetrates the guide 55 from upper and lower end faces of the core 50 so as to enter the heat generating tube 1 and passes through the heat generating tube 1 in a circumferential direction. On the other hand, in portions on both outer sides of the convex portion 50*a*, the core 50 is shorter vertically, and thus as indicated by a dotted line S2 in FIG. 16, magnetic flux passes through the air from the vicinity of the upper end face of the core 50 and enters the heat generating tube 1. Due to a low magnetic permeability in the air, magnetic coupling between the excitation coil 4 and the heat generating tube 1 is weakened. Moreover, the magnetic flux passes through the heat generating tube 1 in a decreased area. Thus, in the case where the switching element 8 is in the disconnected state, in a width direction of the heat generating tube 1, an amount of heat generated in a region that corresponds to the convex portion 50*a*** is larger compared with that in regions on both outer sides of the region.

The description is directed next to the case where the switching element 8 that passes/interrupts an electric current to the suppressing coil 7 is in a connected state. In this case, since passing of magnetic flux through the suppressing coil 7 is suppressed by the suppressing coil 7, as indicated by the dotted line S2, magnetic flux passes through the air from a point slightly below the suppressing coil 7 and enters the heat generating tube 1. That is, by switching the switching element 8 to the connected state, a path of magnetic flux in the portion in which the convex portion 50*a* is formed changes in form from a path indicated by the dotted line S1 to a path indicated by the dotted line S2. As a result, an amount of heat generated in the heat generating tube 1 is made substantially uniform over the entire width.

That is, when the switching element 8 is in the connected state, a heat generation distribution is made substantially uniform over the entire width. Further, when the switching element 8 is in an open state, a heat generation distribution is such that an amount of heat generated in the region corresponding to the convex portion 50*a* is large relative to the regions on both the outer sides of the region.

In this embodiment, as in Embodiment 4, when an electric current induced in the suppressing coil 7 has a value of 0, the switching element 8 connected to the suppressing coil 7 is switched to the disconnected state. Moreover, when a voltage induced in the suppressing coil 7 has a value of 0, the switching element 8 connected to the suppressing coil 7 is switched to the connected state. Thus, the generation of an excessively high voltage in the switching element 8 that interrupts an electric current to the suppressing coil 7 and the occurrence of sparking and insulation destruction can be prevented. At the same time, an abrupt change in electric current and voltage that is caused in the suppressing coil 7 due to switching of the switching element 8 is prevented, and thus the generation of unwanted electromagnetic wave noise also can be prevented.

Furthermore, in this embodiment, the suppressing coil 7 is wound with substantially two turns around the convex portion 50*a*, thereby allowing a substantial effect to be attained compared with the case where the suppressing coil 7 is wound only with one turn.

As is apparent from FIG. 16, by placing the suppressing coil 7, the penetration of magnetic flux through the core 50 in a vertical direction is suppressed. By changing a position in a vertical direction at which the suppressing coil 7 is placed, a distance in which magnetic flux penetrates the core 50 in the vertical direction can be changed. In this case, if the suppressing coil 7 is provided in the vicinity of an upper end of the core 50, magnetic flux penetrates even substantially the upper end of the core 50. Therefore, the larger a distance L1 (see FIG. 17) from the upper end of the core 50 to the suppressing coil 7, the larger a difference in the distance at which magnetic flux penetrates the core 50 in the vertical direction between when the switching element 8 is in the connected state and when the switching element 8 is in the disconnected state. In this embodiment, the position of the suppressing coil 7 in the vertical direction is made substantially equal to the position in the vertical direction of the upper face of the core 50 in portions on both the outer sides of the convex portion 50*a*. Thus, when the switching element 8 is in the connected state, in the width direction, an amount of heat generated in the region in which the convex portion 50*a* is formed can be substantially equal to an amount of heat generated in the regions without the convex portion 50*a* on both the outer sides of the region.

Figure 19:
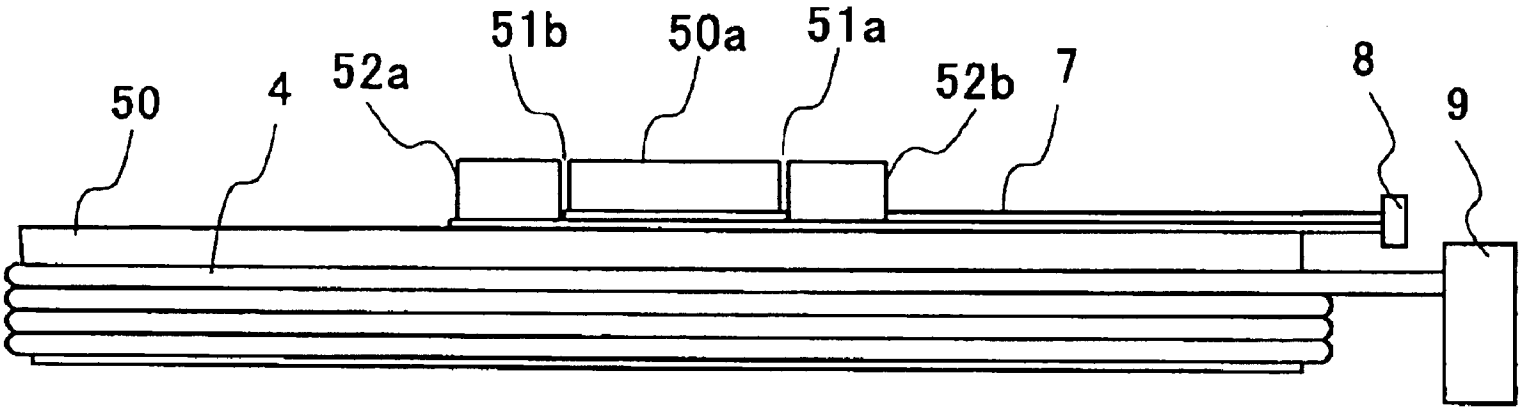
FIG. 19 is a front view showing another example of a configuration of the core of the image heating device according to Embodiment 5 of the present invention.
Figure 20:
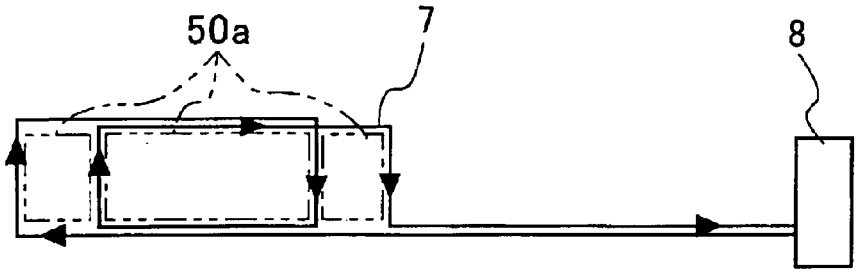
FIG. 20 is a plan view showing directions of an electric current that passes through a suppressing coil wound on the core shown in FIG. 19 at a particular moment.

In the above-mentioned embodiment, as shown in FIG. 18, the suppressing coil 7 was wound with substantially two turns so that the respective turns were wound on substantially the same path so as to overlap each other. However, as shown in FIG. 19, the respective turns may be wound on different paths. That is, as shown in FIG. 19, slots 51*a* and 51*b* are formed vertically in the protruding convex portion 50*a*. A wire bundle of the suppressing coil 7, after being bent at a left side face 52*a* of the convex portion 50*a*, is bent at the slot 51*a*, the slot 51*b*, and a right side face 52*b* in this order. Accordingly, the wire bundle of the suppressing coil 7 forms a first loop between the left side face 52*a* and the slot 51*a* and a second loop between the slot 51*b* and the right side face 52*b*, which is different from the first loop. In FIG. 20, an electric current that passes through the suppressing coil 7 at a particular moment is indicated by an arrow. As is apparent from this, in a portion between the slot 51*a* and the slot 51*b* where the first loop and the second loop of the suppressing coil 7 overlap each other, when the switching element 8 is in the connected state, the effect of suppressing magnetic flux by the suppressing coil 7 is enhanced more than in portions on both sides of the portion, i.e. a portion between the left side face 52*a* and the slot 51*b* and a portion between the slot 51*a* and the right side face 52*b*. Therefore, in the portion between the slot 51*a* and the slot 51*b*, the heat generation suppressing effect can be enhanced more. Thus, in the convex portion 50*a*, heat generation in a center portion can be suppressed, in which cooling by heat transfer hardly is attained due to a large distance from end portions compared with both the end portions in which heat is likely to be removed by heat transfer to the end portions in the width direction. As a result of this, variations in temperature in the width direction can be reduced further.

Figure 21:
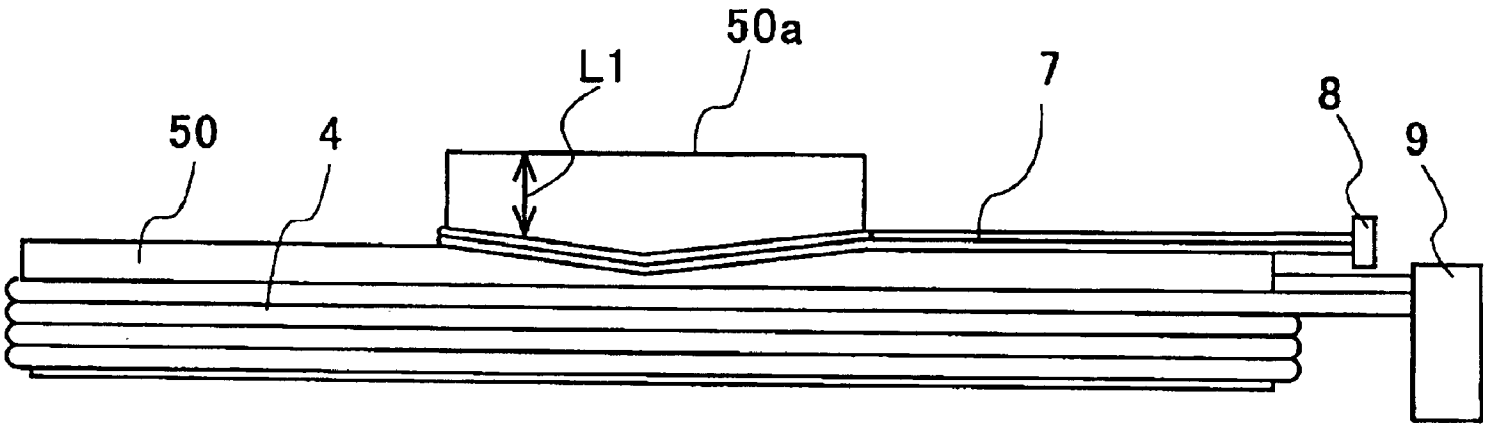
FIG. 21 is a front view showing still another example of the configuration of the core of the image heating device according to Embodiment 5 of the present invention.
Figure 22:
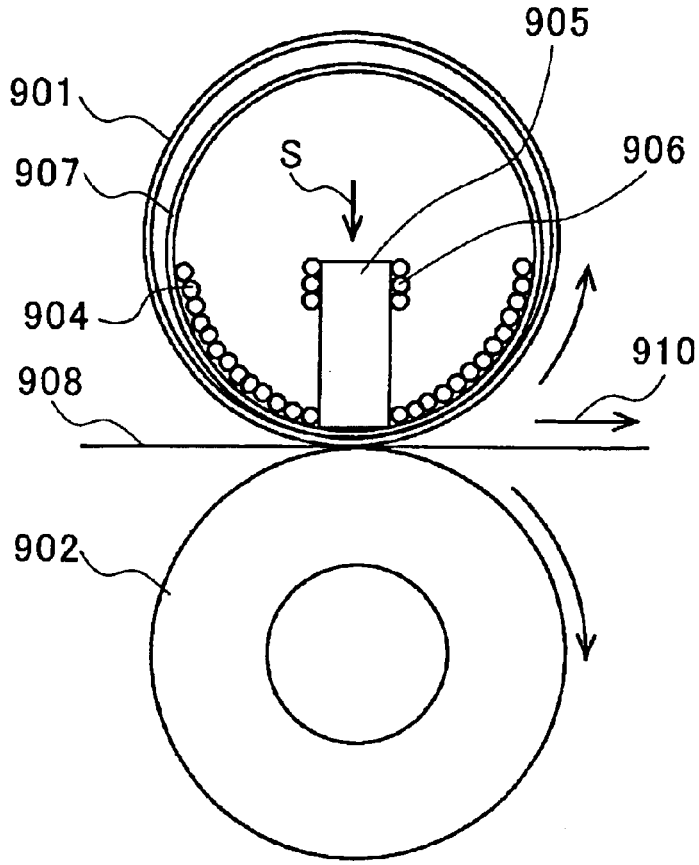
FIG.22 PRIOR ART
FIG. 22 is a cross sectional view of a conventional image heating device.

Furthermore, in the above-mentioned embodiment, the suppressing coil 7 was provided so that magnetic flux passing through a loop formed of a winding of the suppressing coil 7 was orthogonal to a plane including the loop. However, as shown in FIG. 21, a configuration also may be possible in which the suppressing coil 7 is provided so that magnetic flux passing through the loop of the suppressing coil 7 obliquely penetrates the plane including the loop, and the distance (L1) from the upper end face of the core 50 to the suppressing coil 7 along a direction in which magnetic flux penetrates is decreased in a direction toward both the end portions of the convex portion 50*a* in the width direction. As described above, the larger the distance L1 from the upper end face of the core 50 to the suppressing coil 7, the more the heat generation suppressing effect provided by the suppressing coil 7 is enhanced. Therefore, by winding the suppressing coil 7 as shown in FIG. 21, in the width direction of the convex portion 50*a*, the heat generation suppressing effect provided by the suppressing coil 7 is enhanced more in the center portion than in both the end portions. Thus, in the convex portion 50*a*, heat generation in the center portion can be suppressed, in which cooling by heat transfer hardly is attained due to a large distance from the end portions compared with both the end portions in which heat is likely to be removed by heat transfer to the end portions. As a result of this, variations in temperature in the width direction can be reduced further. Further, the heat generation suppressing effect in the width direction can be changed continuously, thereby allowing variations in temperature in the width direction to be reduced even further.

In this embodiment, as shown in FIG. 16, the description was directed to an example in which the core 50 was rectangular in cross section in a plane orthogonal to the rotation axis of the heat generating tube 1. However, the shape of the core 50 in cross section is not limited thereto. The same configuration can be obtained by using, for example, a T-shaped core that is split in a lateral direction at a portion on which the suppressing coil 7 is not wound, and a L-shaped core that is bent so as to be L-shape in cross section.

Moreover, in this embodiment, the core 50 was continuous in the width direction. However, the core 50 also can be divided in a longitudinal direction. In this case, the suppressing coil 7 can be formed by bending the wire bundle of the suppressing coil 7 at a gap between portions of the core into which the core is divided.

The embodiments disclosed in this application are intended to illustrate the technical aspects of the invention and not to limit the invention thereto. The invention may be embodied in other forms without departing from the spirit and the scope of the invention as indicated by the appended claims and is to be broadly construed.

What is claimed is:

1. An image heating device, comprising:

a conductive heat generating member that transfers heat directly or indirectly to a body to be heated that is allowed to travel while carrying an image;

an excitation unit that is provided close to the heat generating member and generates magnetic flux so as to cause the heat generating member to generate heat by electromagnetic induction; and a heat generation suppressing unit that suppresses heat generation of the heat generating member by regulating the magnetic flux generated by the excitation unit, wherein the heat generation suppressing unit suppresses heat generation of the heat generating member not in a whole area but in a part of a region that is caused to generate heat by the excitation unit and corresponds to a region including at least a center portion of the body to be heated in a width direction.

2. The image heating device according to claim 1, wherein bodies to be heated of varying dimensions in the width direction are allowed to travel such that a center position of each of the bodies to be heated in the width direction coincides with a common position substantially at a center of the hear generating member.

3. The image heating device according to claim 1, wherein the heat generation suppressing unit cancels out at least part of the magnetic flux generated by the excitation unit using an electric current induced by an induction electromotive force that is generated due to the magnetic flux generated by the excitation unit.

4. The image heating device according to claim 1, wherein the excitation unit includes a plurality of cores that are arranged at a distance from each other in the width direction and an excitation coil, and a distance between the adjacent cores in a center portion in the width direction is smaller than a distance between the adjacent cores in each of end portions in the width direction.

5. The image heating device according to claim 1, wherein the excitation unit includes a plurality of cores that are arranged at a distance from each other in the width direction and an excitation coil, and of the plurality of cores, at least the core positioned in a center portion in the width direction is moved by the heat generation suppressing unit.

6. The image heating device according to claim 1, wherein the excitation unit includes a plurality of cores that are arranged in the width direction and an excitation coil, and the core arranged in a center portion in the width direction has a magnetic permeability higher than a magnetic permeability of the core arranged in each of end portions in the width direction.

7. The image heating device according to claim 1, wherein the excitation unit includes a plurality of cores that are arranged in the width direction and an excitation coil, and a cross sectional area in a plane orthogonal to the magnetic flux of the core arranged in a center portion in the width direction is larger than a cross sectional area in the plane orthogonal to the magnetic flux of the core arranged in each of end portions in the width direction.

8. The image heating device according to claim 1, wherein the heat generation suppressing unit includes a loop-shaped conductor that links to at least part of the magnetic flux generated by the excitation unit and a switching unit that makes/interrupts electrical connection to a loop of the conductor.

9. The image heating device according to claim 8, wherein the loop-shaped conductor is disposed so that a region in which the body to be heated of a small width is passed is overlapped with at least part of the conductor.

10. The image heating device according to claim 8, wherein when a body to be heated of a small width is passed, the switching unit opens the loop of the conductor.

11. The image heating device according to claim 8, wherein the excitation unit includes an excitation power source that generates an electric current varying with time and an excitation coil that is supplied with an electric current by the excitation power source, and when an electric current induced in the loop of the conductor has a value in the vicinity of 0, the switching unit is switched over.

12. The image heating device according to claim 11, wherein when the switching unit is switched over an electric current is not applied to the excitation coil.

13. The image heating device according to claim 8, wherein the excitation unit includes an excitation power source that generates an electric current varying with time and an excitation coil that is supplied with an electric current by the excitation power source, and when a voltage induced in the loop of the conductor has a value in the vicinity of 0, the switching unit is switched over.

14. The image heating device according to claim 13, wherein when the switching unit is switched over, an electric current is not applied to the excitation coil.

15. The image heating device according to claim 8, wherein the excitation unit includes an excitation power source that generates an electric current varying with time and an excitation coil that is supplied with an electric current by the excitation power source, and the switching unit is switched over in synchronization with a change in an electric current or a voltage of the excitation coil.

16. The image heating device according to claim 8, wherein the conductor forms a plurality of loops, and at least one of the plurality of loops links to magnetic flux that does not link to the other loops.

17. The image heating device according to claim 8, wherein the loop of the conductor is inclined with respect to magnetic flux linking to the loop of the conductor.

18. An image forming apparatus comprising an image heating device as claimed in claim 1, wherein the image heating device fixes a toner image carried by a recording paper sheet.

* * * * *